US007822217B2

(12) United States Patent
Hagen et al.

(10) Patent No.: US 7,822,217 B2
(45) **Date of Patent: *Oct. 26, 2010**

(54) HEARING ASSISTANCE SYSTEMS FOR PROVIDING SECOND-ORDER GRADIENT DIRECTIONAL SIGNALS

(75) Inventors: Lawrence Hagen, Deephaven, MN (US); Mark A. Bren, Lorretto, MN (US); Randall W. Roberts, Eden Prairie, MN (US); Timothy S. Peterson, Lino Lakes, MN (US); David A. Preves, Princeton Junction, NJ (US)

(73) Assignee: Micro Ear Technology, Inc., Plymouth, MN (US)

( * ) Notice: Subject to any disclaimer, the term of this patent is extended or adjusted under 35 U.S.C. 154(b) by 437 days.

This patent is subject to a terminal disclaimer.

(21) Appl. No.: 12/115,423

(22) Filed: May 5, 2008

(65) Prior Publication Data

US 2008/0273727 A1 Nov. 6, 2008

Related U.S. Application Data

(63) Continuation of application No. 10/146,536, filed on May 15, 2002, now Pat. No. 7,369,669.

(51) Int. Cl.
*H04R 25/00* (2006.01)

(52) U.S. Cl. ..... 381/313; 381/23.1; 381/92; 381/315

(58) Field of Classification Search ..... 381/312–318, 381/92, 23.1, 97

See application file for complete search history.

(56) References Cited

U.S. PATENT DOCUMENTS 3,527,901 A 9/1970 Geib (Continued)

FOREIGN PATENT DOCUMENTS

EP 1174003 B1 7/2004

(Continued)

OTHER PUBLICATIONS

U.S. Appl. No. 09/052,631 Final Office Action mailed Jul. 11, 2000, 8 pgs.

(Continued)

*Primary Examiner*—Vivian Chin
*Assistant Examiner*—Jason R Kurr
(74) *Attorney, Agent, or Firm*—Schwegman, Lundberg & Woessner, P.A.

(57) ABSTRACT

Systems, devices and methods are provided for diotically presenting second-order gradient directional hearing aid signals. The present subject matter provides an improved signal-to-noise ratio, and presents a desired directional signal to each ear. One aspect is a hearing aid system. In one embodiment, the system includes a first microphone system in a first device and a second microphone system in a second device. The first microphone system has a first output signal, and the second microphone system has a second output signal. Each output signal includes a first-order directional signal. The system further includes a first receiver circuit and a second receiver circuit. The combination of the first output signal and the second output signal provides a diotic presentation of a second-order gradient signal to both the first receiver circuit and the second receiver circuit. Other aspects are provided herein.

9 Claims, 15 Drawing Sheets

U.S. PATENT DOCUMENTS

| | | | | |
|---|---|---|---|---|
| 3,571,514 | A | 3/1971 | Wruk | |
| 3,770,911 | A | 11/1973 | Knowles et al. | |
| 3,798,390 | A | 3/1974 | Gage et al. | |
| 3,836,732 | A | 9/1974 | Johanson et al. | |
| 3,875,349 | A | 4/1975 | Ruegg | |
| 3,946,168 | A | 3/1976 | Preves | |
| 3,975,599 | A | 8/1976 | Johanson | |
| 4,051,330 | A | 9/1977 | Cole | |
| 4,142,072 | A | 2/1979 | Berland | |
| 4,366,349 | A | 12/1982 | Adelman | |
| 4,396,806 | A | 8/1983 | Anderson | |
| 4,419,544 | A | 12/1983 | Adelman | |
| 4,449,018 | A | 5/1984 | Stanton | |
| 4,456,795 | A | 6/1984 | Saito | |
| 4,471,490 | A | 9/1984 | Bellafiore | |
| 4,622,440 | A | 11/1986 | Slavin | |
| 4,637,402 | A | 1/1987 | Adelman | |
| 4,712,244 | A | 12/1987 | Zwicker et al. | |
| 4,723,293 | A | 2/1988 | Harless | |
| 4,751,738 | A | 6/1988 | Widrow et al. | |
| 4,882,762 | A | 11/1989 | Waldhauer | |
| 5,029,215 | A | 7/1991 | Miller, II | |
| 5,214,709 | A | 5/1993 | Ribic | |
| 5,226,087 | A | 7/1993 | Ono et al. | |
| 5,289,544 | A | 2/1994 | Franklin | |
| 5,390,254 | A | 2/1995 | Adelman | |
| 5,434,924 | A | 7/1995 | Jampolsky | |
| 5,479,522 | A | 12/1995 | Lindemann et al. | |
| 5,483,599 | A | 1/1996 | Zagorski | |
| 5,502,769 | A | 3/1996 | Gilbertson | |
| 5,524,056 | A | 6/1996 | Killion et al. | |
| 5,553,152 | A | 9/1996 | Newton | |
| 5,581,747 | A | 12/1996 | Anderson | |
| 5,659,621 | A | 8/1997 | Newton | |
| 5,757,932 | A | 5/1998 | Lindemann et al. | |
| 5,757,933 | A | 5/1998 | Preves et al. | |
| 5,822,442 | A | 10/1998 | Agnew et al. | |
| 5,825,631 | A | 10/1998 | Prchal | |
| 5,835,611 | A | 11/1998 | Kaiser et al. | |
| 5,852,668 | A | 12/1998 | Ishige et al. | |
| 5,862,238 | A | 1/1999 | Agnew et al. | |
| 5,991,419 | A | 11/1999 | Brander | |
| 6,041,129 | A | 3/2000 | Adelman | |
| 6,236,731 | B1 | 5/2001 | Brennan et al. | |
| 6,240,192 | B1 | 5/2001 | Brennan et al. | |
| 6,347,148 | B1 | 2/2002 | Brennan et al. | |
| 6,366,863 | B1 | 4/2002 | Bye et al. | |
| 6,389,142 | B1 | 5/2002 | Hagen et al. | |
| 6,449,662 | B1 | 9/2002 | Armitage | |
| 6,549,633 | B1 | 4/2003 | Westermann | |
| 7,103,191 | B1 | 9/2006 | Killion | |
| 7,116,792 | B1 | 10/2006 | Taenzer et al. | |
| 7,369,669 | B2 | 5/2008 | Hagen et al. | |
| 7,590,253 | B2 * | 9/2009 | Killion | 381/313 |
| 2001/0007050 | A1 | 7/2001 | Adelman | |
| 2002/0076073 | A1 | 6/2002 | Taenzer et al. | |
| 2002/0186857 | A1 | 12/2002 | Bren et al. | |

FOREIGN PATENT DOCUMENTS

| | | | |
|---|---|---|---|
| WO | WO-00/21332 | | 4/2000 |
| WO | WO-0203750 | A2 | 1/2002 |
| WO | WO-0223950 | A2 | 3/2002 |

OTHER PUBLICATIONS

U.S. Appl. No. 09/052,631 Final Office Action mailed Jul. 30, 2001, 5 pgs.

U.S. Appl. No. 09/052,631 Non Final Office Action mailed Jan. 18, 2001, 6 pgs.

U.S. Appl. No. 09/052,631 Non Final Office Action mailed Dec. 28, 1999, 10 pgs.

U.S. Appl. No. 09/052,631 Notice of Allowance mailed Dec. 18, 2001, 6 pgs.

U.S. Appl. No. 09/052,631 Response filed May 18, 2001 to Non Final Office Action mailed Jan. 18, 2001, 7 pgs.

U.S. Appl. No. 09/052,631 Response filed Oct. 30, 2001 to Final Office Action mailed Jul. 30, 2001, 5 pgs.

U.S. Appl. No. 09/052,631 Response filed Nov. 10, 2000 to Final Office Action mailed Jul. 11, 2000, 5 pgs.

U.S. Appl. No. 10/146,536, Notice of Allowance mailed Dec. 27, 2007, 10 pgs.

U.S. Appl. No. 10/146,536, Response filed Nov. 19, 2007 to Final Office Action mailed May 18, 2007, 19 pgs.

U.S. Appl. No. 10/146,536, Response filed Sep. 18, 2007 to Final Office Action dated Jun. 18, 2007, 24 pages.

European Search Report for Application No. EP 03 25 3052, (Nov. 24, 2005),2 pgs.

"Microphone Unit 6903", Technical Data Sheet published by Microtronic,(Dec. 2000),2 pgs.

Davis, A. , et al., "Magnitude of Diotic Summation in Speech-in-Noise Tasks:Performance Region and Appropriate Baseline", *British Journal of Audiology*, 24, (1990), 11-16.

Griffing, Terry S., et al., "Acoustical Efficiency of Canal ITE Aids", *Audecibel*, (Spring 1983),30-31.

Griffing, Terry S., et al., "Custom canal and mini in-the-ear hearing aids", *Hearing Instruments*, vol. 34, No. 2, (Feb. 1983),31-32.

Griffing, Terry S., et al., "How to evaluate, sell, fit and modify canal aids", *Hearing Instruments*, vol. 35, No. 2, (Feb. 1984),3.

Halverson, H. M., "Diotic Tonal Volumes as a Function of Difference of Phase", *The American Journal of Psychology*, 33(4), (Oct. 1922),526-534.

Mahon, William J., "Hearing Aids Get a Presidential Endorsement", *The Hearing Journal*,, (Oct. 1983),7-8.

Preves, David A., "Field Trial Evaluations of a Switched Directional/Omnidirectional In-the-Ear Hearing Instrument", *Journal of the American Academy of Audiology*, 10(5), (May 1999),273-283.

Sullivan, Roy F., "Custom canal and concha hearing instruments: A real ear comparison", *Hearing Instruments*, 40(4), (Jul. 1989),5.

Sullivan, Roy F., "Custom canal and concha hearing instruments: A real ear comparison Part II", *Hearing Instruments*, vol. 40, No. 7, (Jul. 1989),6.

Teder, Harry , "Something New In CROS", *Hearing Instruments*, vol. 27, No. 9, Published by Harcourt Brace Jovanovich,(Sep. 1976),pp. 18-19.

Zelnick, E. , "The Importance of Interaural Auditory Differences in Binaural Hearing", *In: Binaural Hearing and Amplification*, vol. 1, Libby, E. R., Editor, Zenetron, Inc., Chicago, IL,(1980),81-103.

"European Application Serial No. 03253052.9, Office Action mailed Mar. 26, 2009", 3 pgs.

"U.S. Appl. No. 10/146,536, Advisory Action mailed Oct. 16, 2007", 5 pgs.

"U.S. Appl. No. 10/146,536, Final Office Action mailed May 18, 2007", 28 pgs.

"U.S. Appl. No. 10/146,536, Non-Final Office Action mailed Sep. 19, 2006", 26 pgs.

"U.S. Appl. No. 10/146,536, Non-Final Office Action mailed Dec. 16, 2005", 25 pgs.

"U.S. Appl. No. 10/146,536, Response filed Feb. 20, 2007 to Non-Final Office Action mailed Sep. 19, 2006", 20 pgs.

"U.S. Appl. No. 10/146,536, Response filed Jun. 16, 2006 to Non-Final Office Action mailed Dec. 16, 2005", 14 pgs.

"Canadian Application No. 2,428,908, Office action mailed Mar. 15, 2007", 6 pgs.

"Canadian Application No. 2,428,908, Office action mailed Nov. 04, 2008", 9 pgs.

* cited by examiner

HEARING ASSISTANCE SYSTEMS FOR PROVIDING SECOND-ORDER GRADIENT DIRECTIONAL SIGNALS

RELATED APPLICATION

This application is a continuation under 37 C.F.R. 1.53(b) of U.S. Ser. No. 10/146,536 filed May 15, 2002 now U.S. Pat. No. 7,369,669, which is incorporated herein by reference in its entirety and made a part hereof.

TECHNICAL FIELD

This application relates generally to hearing aid systems and, more particularly, to systems, devices and methods for providing hearing aid signals with more directionality.

BACKGROUND

A non-directional hearing aid system allows a wearer to pickup sounds from any direction. When a hearing aid wearer is trying to carry on a conversation within a crowded room, a non-directional hearing aid system does not allow the wearer to easily differentiate between the voice of the person to whom the wearer is talking and background or crowd noise.

A directional hearing aid helps the wearer to hear the voice of the person with whom the wearer is talking, while reducing the miscellaneous crowd noise present within the room. One directional hearing aid system is implemented with a single microphone having inlets to cavities located in front and back of a diaphragm. An acoustic resistor placed across a hole in the back inlet of the microphone, in combination with the compliance formed by the volume of air behind the diaphragm, provides the single microphone with directionality. This directional hearing aid system is termed a first-order pressure gradient directional microphone. The term gradient refers to the differential pressure across the diaphragm. A first-order pressure gradient directional microphone relates to a microphone system that produces a signal based on the pressure differential across a single diaphragm.

One measure of the amount of directivity of a directional hearing aid system uses a polar directivity pattern, which shows the amount of pickup at a specific frequency (in terms of attenuation in dB) of a directional hearing aid system as a function of azimuth angle of sound incidence. A directivity index is the ratio of energy arriving from in front of the hearing aid wearer to the random energy incident from all directions around an imaginary sphere with the hearing aid at its center.

A first-order pressure gradient directional hearing aid microphone is capable of producing both a cardioid polar pattern and a super cardioid polar pattern. A cardioid polar pattern produces a directivity index of about 3-4 dB. A super cardioid polar pattern produces a directivity index of about 5-6 dB.

Persons with an unaidable unilateral hearing loss or persons having one ear that cannot be aided with a hearing aid (known as a dead ear) and one ear with some aidable hearing loss often have great difficulty communicating in high noise levels. These persons lose their auditory system's normal ability to suppress noise. With respect to a normal auditory system, the brain uses the balanced, fused, binaurally-processed inputs from the two normal cochleas of a normal hearing person, and cross-correlates these inputs to suppress noise.

Contralateral Routing Of Signals (CROS) and Bilateral Routing Of Signals (BI-CROS) hearing aids, respectively, are often employed for such persons since they often have great difficulty wearing only one hearing aid. CROS and BI-CROS system take sound from the bad ear, process it, then send the processed sound via hard wire, RF, or induction transmission to a receiver in the other ear.

CROS systems are used for individuals with on unaidable ear and one ear with normal hearing or a mild hearing loss. CROS systems includes a microphone and a receiver. A microphone is worn on the unaidable ear, and the receiver is worn on the better ear. BI-CROS systems are used for individuals having one unaidable ear and one ear needing amplification. BI-CROS systems include two microphones and a receiver. In the BI-CROS system, a microphone is worn on each ear, and the receiver is worn on the better ear. CROS and BI-CROS hearing aids overcome the loss of about 6 dB caused by the head blocking and diffracting sounds incident to one ear (the dead side) as they cross over to the better ear.

There is a need in the art to provide improved systems, devices and methods for providing hearing aid signals with more directionality to improve communications in high noise levels.

SUMMARY

The above mentioned problems are addressed by the present subject matter and will be understood by reading and studying the following specification. The present subject matter provides improved systems, devices and methods for providing hearing aid signals with more directionality to improve communications in high noise levels.

The hearing aid system provides a directional microphone system and a receiver at each ear. Output signals from the directional microphone systems are combined to provide a second-order gradient directional signal, which is presented to both receivers. The second-order gradient directional signal provides an improved signal-to-noise ratio due to a greater reduction of ambient noise from the sides and back of the hearing aid wearer. Present data indicates that a directivity index of about 9 dB is capable of being obtained throughout most of the frequency range with the second-order gradient directional microphone scheme. Improved communication in high noise levels is achieved due to the increase in directivity index from about 6 to 9 dB, and the presentation of the desired signal to both ears.

One aspect of the present subject matter is a hearing aid system. According to one embodiment, the system includes a first microphone system, a second microphone system, a first receiver circuit and a second receiver circuit. The first microphone system and the first receiver circuit are positioned in a first device, and the second microphone system and the second receiver circuit are positioned in a second device. The first microphone system receives sound and has a first output signal representative of the sound received. The second microphone system receives sound and has a second output signal representative of the sound received. Both the first output signal and the second output signal include a first-order gradient directional hearing aid signal. The first receiver circuit is connected to the first microphone system to receive the first output signal and is connected to the second microphone system to receive the second output signal. The second receiver circuit is connected to the first microphone system to receive the first output signal and is connected to the second microphone system to receive the second output signal. The combination of the first output signal and the second output signal provide a diotic presentation of a second-order gradient signal to the first receiver circuit and the second receiver circuit.

In one embodiment, the hearing aid system includes a first hearing aid device and a second hearing device. Each hearing device includes a microphone system for receiving a sound and providing a signal representative of the sound. Each hearing device further includes a switch for selecting a mode of operation to provide a selected signal. Each hearing device further includes signal processing circuitry for receiving and processing the selected signal into a processed signal representative of the sound. Each hearing device further includes a receiver for receiving the processed signal to produce a processed sound that aids hearing. The microphone system includes a directional microphone system for providing a first-order pressure gradient directional signal representative of the sound, and an omnidirectional microphone system for providing an omnidirectional signal representative of the sound. In one embodiment, the directional microphone system includes a set of omnidirectional microphone systems. When an omnidirectional mode of operation is selected, the selected signal includes the omnidirectional signal representative of the sound. When a first-order gradient directional mode of operation is selected, the selected signal includes the first-order pressure gradient directional signal. When a second-order gradient directional mode of operation is selected, the selected signal includes a sum of the first-order pressure gradient directional signals from the microphone system for both the first and the second hearing aid devices.

One aspect is a method for diotically presenting second-order gradient directional signals to a wearer of hearing aids. In one embodiment of the method, a sound is received both at a first microphone system in a first hearing aid device and a second microphone system in a second hearing aid device. Both the first microphone system and the second microphone system provide a first-order gradient directional signal representative of the sound received. The first-order gradient signals provided by the first microphone system and the second microphone system are summed to provide a second-order gradient directional signal. The second-order gradient directional signal is presented to a first receiver in the first hearing aid device and to a second receiver in the second hearing aid device.

One aspect is a method for aiding hearing for a user wearing a first hearing aid unit and a second hearing aid unit. A sound is received at a first microphone system in the first hearing aid unit and at a second microphone system in the second hearing aid unit. For a first mode of operation, a first omnidirectional signal representative of the sound from the first microphone system is provided to a first receiver in the first hearing aid unit. A second omnidirectional signal representative of the sound from the second microphone system is provided to a second receiver in the second hearing aid unit. For a second mode of operation, a first directional signal representative of the sound from the first microphone system is provided to the first receiver in the first hearing aid unit. A second directional signal representative of the sound from the second microphone system is provided to the second receiver in the second hearing aid unit. For a third mode of operation, the first directional signal from the first microphone system is summed with the second directional signal from the second microphone system to form a second-order gradient directional signal representative of the sound. The second-order gradient directional signal is diotically presented to the first receiver in the first hearing aid unit and to the second receiver in the second hearing aid unit.

These and other aspects, embodiments, advantages, and features will become apparent from the following description and the referenced drawings.

DETAILED DESCRIPTION

Figure 1:
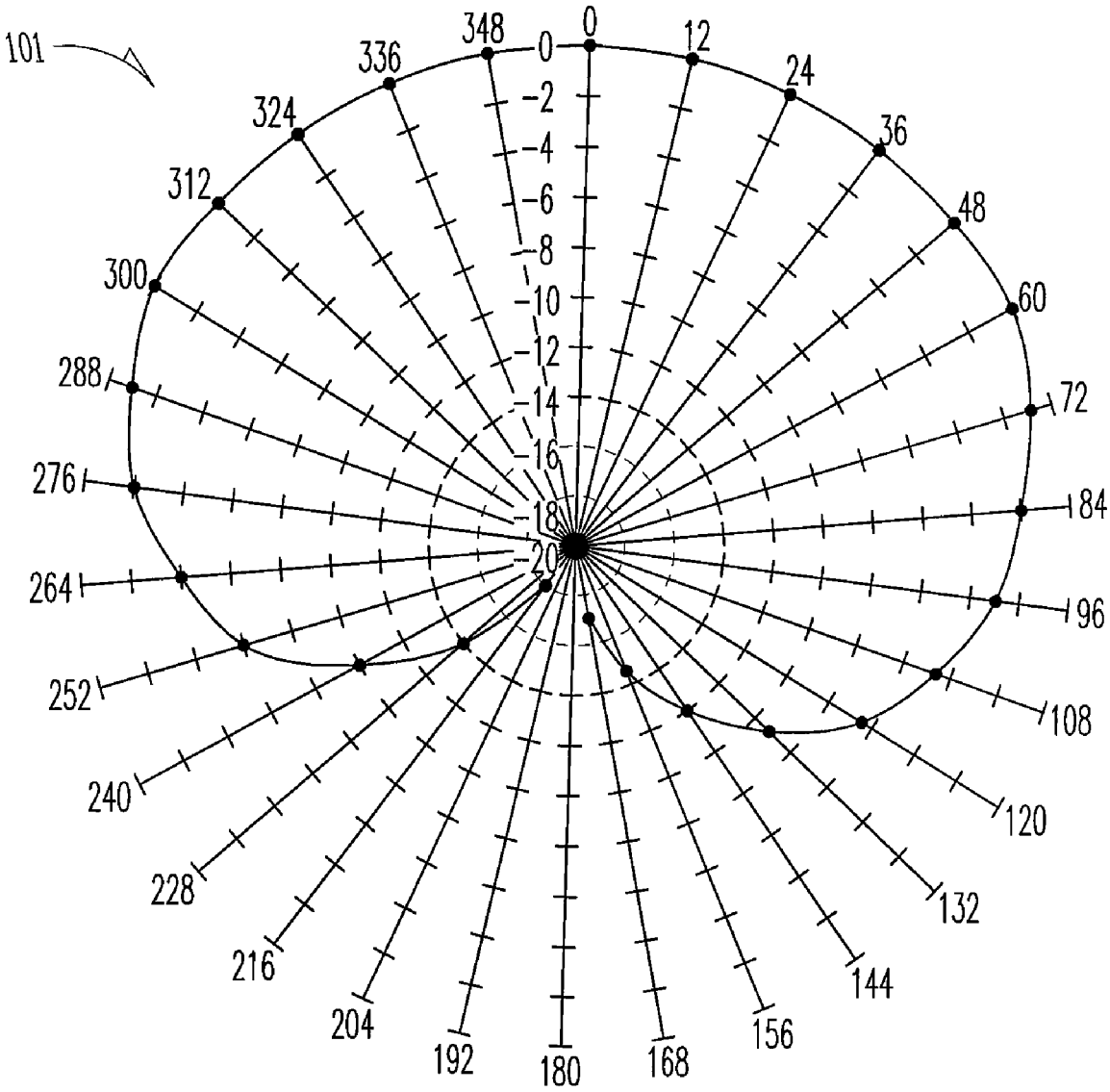
FIG. 1 illustrates a cardioid polar directivity pattern of a hearing aid that provides a directional signal representative of a received sound.

The following detailed description of the present subject matter refers to the accompanying drawings which show, by way of illustration, specific aspects and embodiments in which the present subject matter may be practiced. In the drawings, like numerals describe substantially similar components throughout the several views. These embodiments are described in sufficient detail to enable those skilled in the art to practice the present subject matter. Other embodiments may be utilized and structural, logical, and electrical changes may be made without departing from the scope of the present subject matter. The following detailed description is, therefore, not to be taken in a limiting sense, and the scope of the present subject matter is defined only by the appended claims, along with the full scope of equivalents to which such claims are entitled.

FIG. 1 illustrates a cardioid polar directivity pattern of a hearing aid that provides a directional signal representative of a received sound. The polar directivity pattern provides one measure of the amount of directivity of a directional hearing aid system. The polar directivity pattern 101 shows the amount of pickup at a specific frequency (in terms of attenuation in Db) of a directional hearing aid system as a function of azimuth angle of sound incidence. Accurate measurement of a polar directivity pattern requires an anechoic chamber. An anechoic chamber is an enclosed room that reduces sound reflection from its inner wall surfaces and that attenuates ambient sounds entering from the outside. Thus, inside an anechoic chamber, the direction of arrival of sound can be controlled so that it comes from only on specific angle of incidence. A cardioid or heart-shaped polar pattern 101 produces a directivity index of about 3-4 dB. The directivity index is the ratio of energy arriving from in front of the hearing aid wearer to the random energy incident from all directions around and imaginary sphere with the hearing aid at its center.

Figure 2:
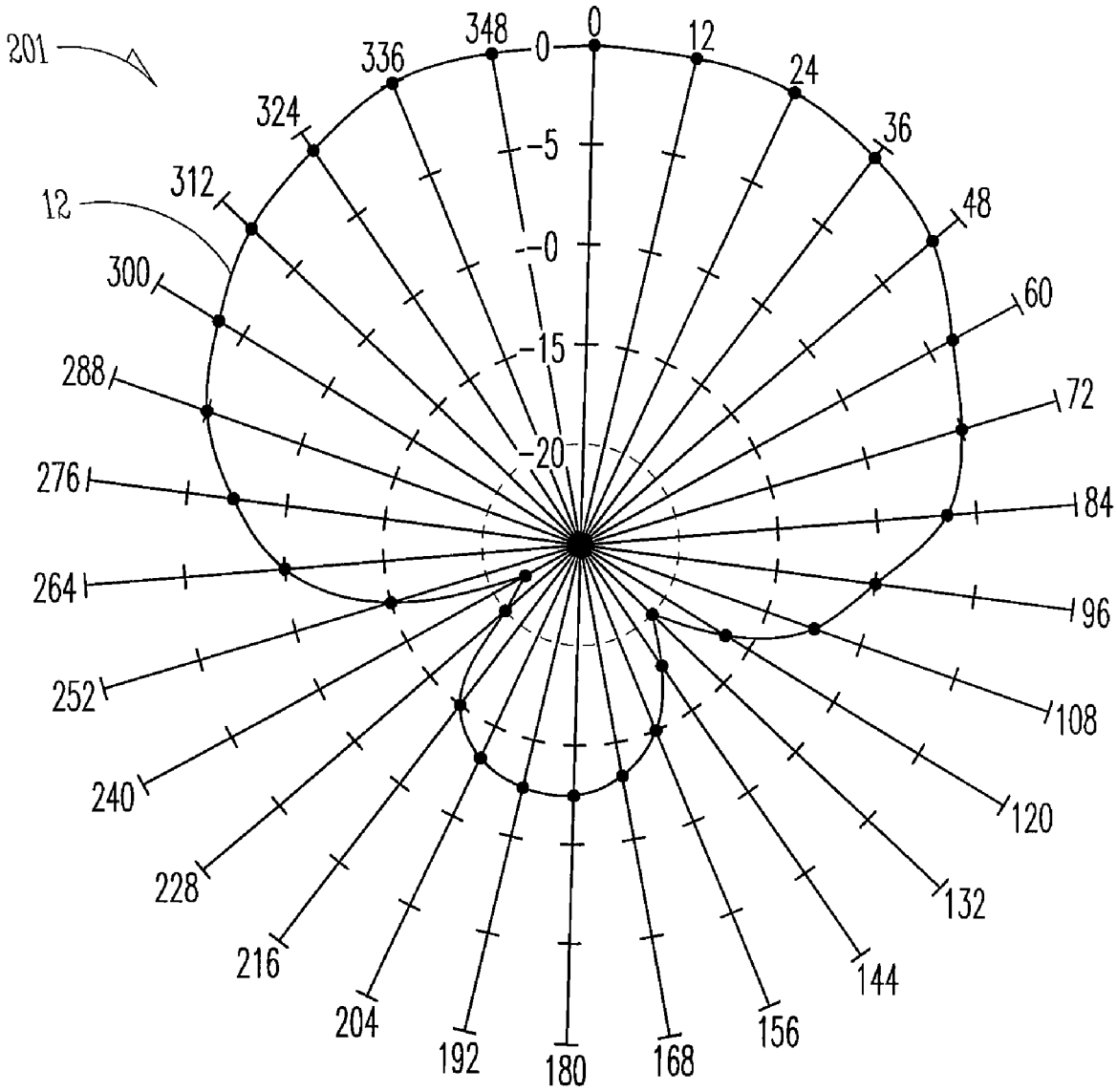
FIG. 2 illustrates a super cardioid polar directivity pattern of a hearing aid that provides a directional signal representative of a received sound.

FIG. 2 illustrates a super cardioid polar directivity pattern of a hearing aid that provides a directional signal representative of a received sound. A super cardioid polar pattern 201, which can also be obtained with a first order pressure gradient directional hearing aid microphone, produces a 5-6 dB directivity index.

Figure 3:
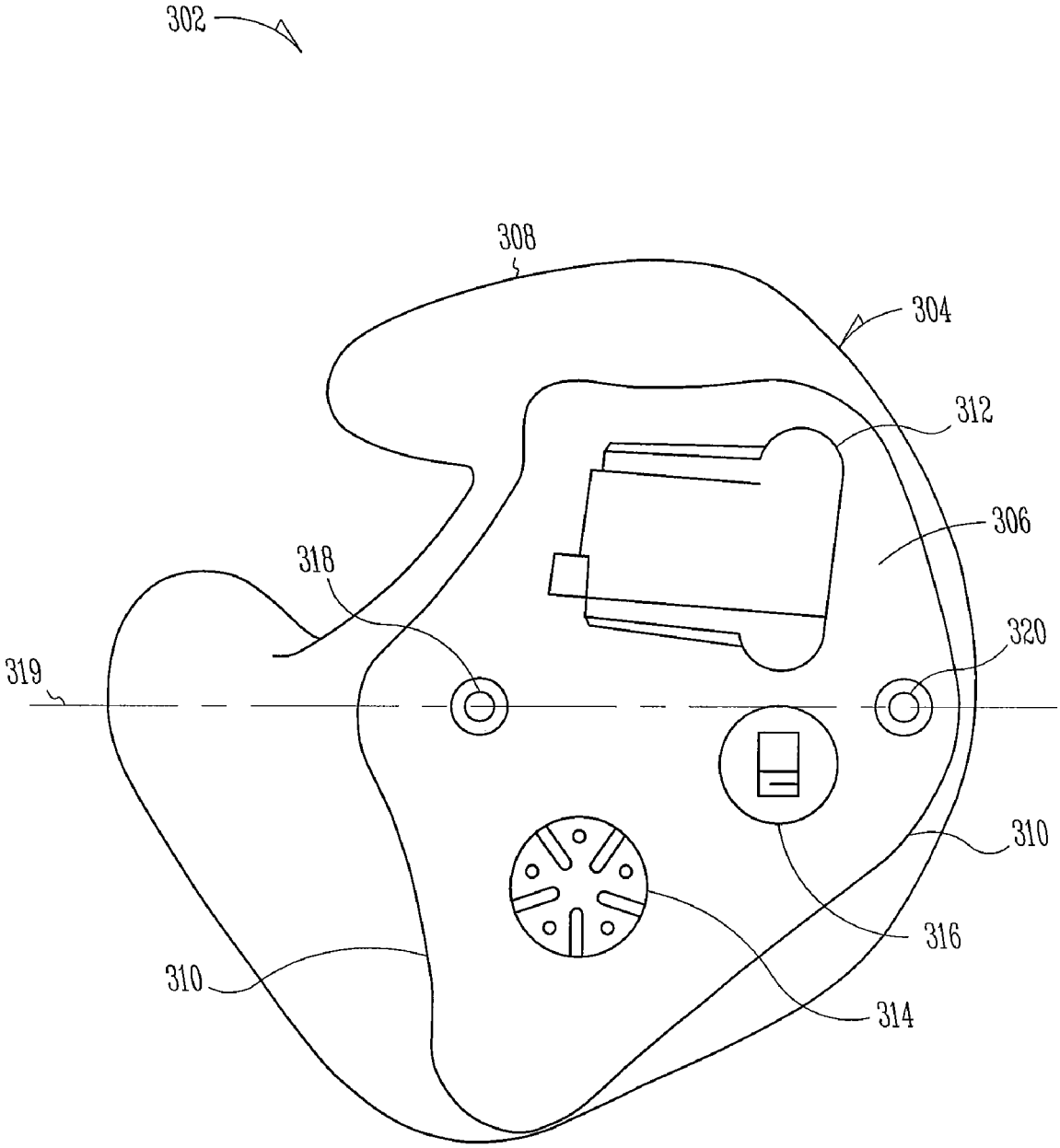
FIG. 3 illustrates a perspective view of one embodiment of an in-the-ear hearing device.

FIG. 3 illustrates a perspective view of one embodiment of an in-the-ear hearing device. The in-the-ear hearing aid 302 includes a housing 304 having a face plate 306 and a molded shell 308. The molded shell 308 is adhered to the face plate 306, indicated along line 310. The molded shell 308 is custom molded to fit each individual hearing aid wearer by known processes, such as making an impression of the individual hearing aid wearer's ear and forming the molded shell based on that impression. The face plate 306 is coupled to a circuit board (not shown) located inside the in-the-ear hearing aid 308, which contains the circuitry for the hearing aid device.

Extending through the in-the-ear hearing aid 308 and specifically face plate 306, is a battery door 312, a volume control 314, a switch 316, and at least one microphone 318 and 320. The battery door 312 allows the hearing aid wearer access to change the battery (not shown). The volume control 314 allows the hearing aid wearer to adjust the volume or amplification level of the hearing aid. Switch 316 extends through the housing 304 and specifically face plate 306. Switch 316 allows the hearing aid wearer to manually switch the in-the-ear hearing aid among two or more modes of operation. Switch 316 is electronically coupled to the circuit contained within the in-the-ear hearing aid, which will be described in further detail later in the specification. In one embodiment, which will be described in further detail below, a hearing aid system according to the present subject matter can be switched among an omnidirectional (or non-directional) hearing aid mode to hear sounds from all directions, a first-order directional hearing aid mode, such as for reducing background noise when carrying on a conversation in a crowded or noisy room, and a second-order directional hearing aid mode, such as for further reducing background noise when carrying on a conversation in a noisier room.

Figure 4:
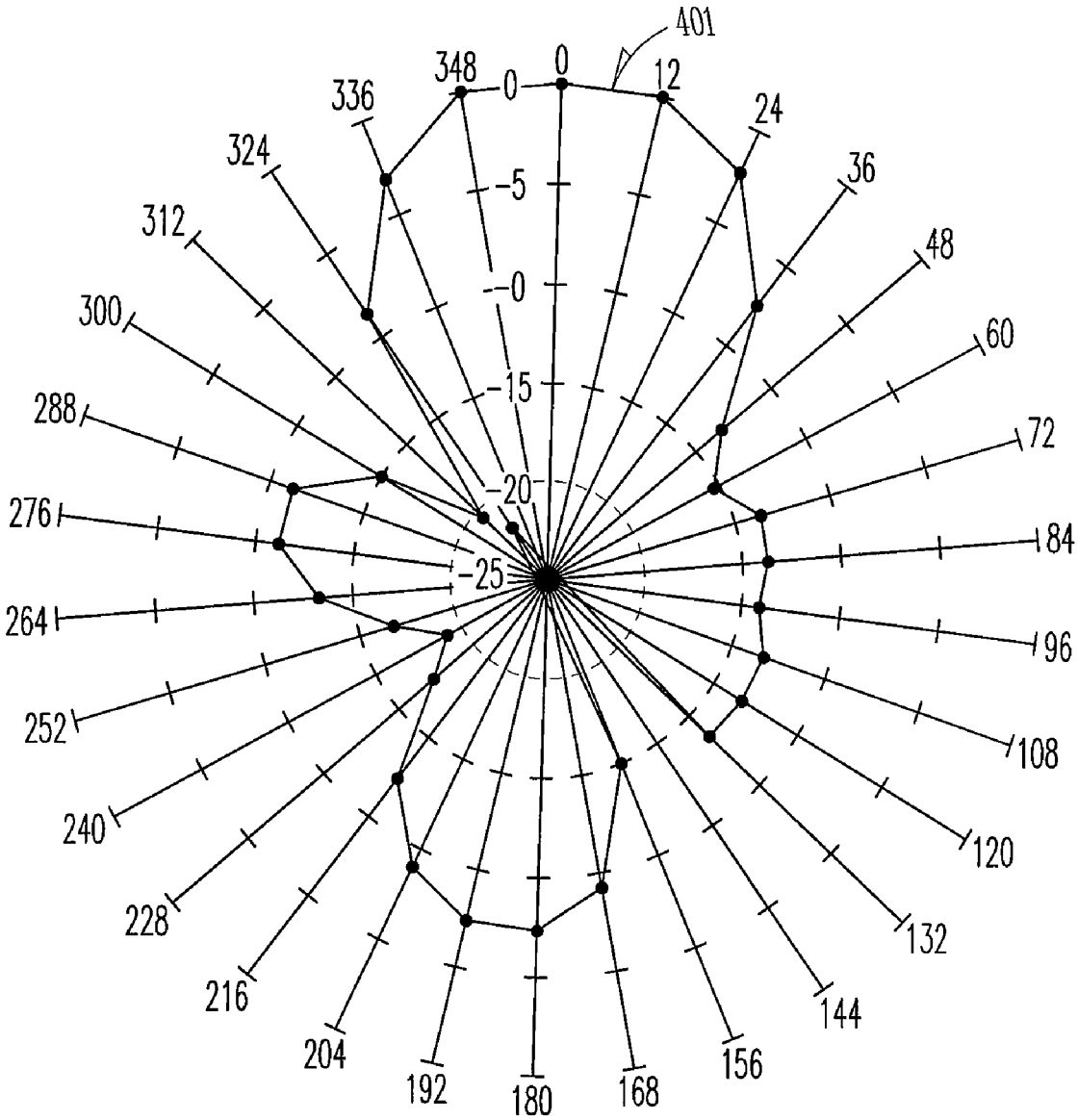
FIG. 4 illustrates a polar directivity pattern of a second-order gradient directional signal provided by a combination of two directional signals.

FIG. 4 illustrates a polar directivity pattern of a second-order gradient directional signal provided by a combination of two directional signals. The polar directivity pattern 401 shows the amount of pickup at a specific frequency (in this case, 1K) of a hearing aid system as a function of azimuth angle of sound incidence. In the illustrated pattern, the Directivity Index (DI—the ratio of sounds incident straight ahead to those incident all around an imaginary sphere) was 10.1 dB and the Unidirectional Index (UDI—the ratio of sounds incident on an imaginary front hemisphere to those from an imaginary rear hemisphere) was 5.0 dB. This polar pattern 110 indicates that sounds incident from the sides and rear will be significantly attenuated. The DI predicts up to a 10 dB improvement in signal-to-noise ratio, depending upon the amount of reverberation in the listening environment.

Figure 5:
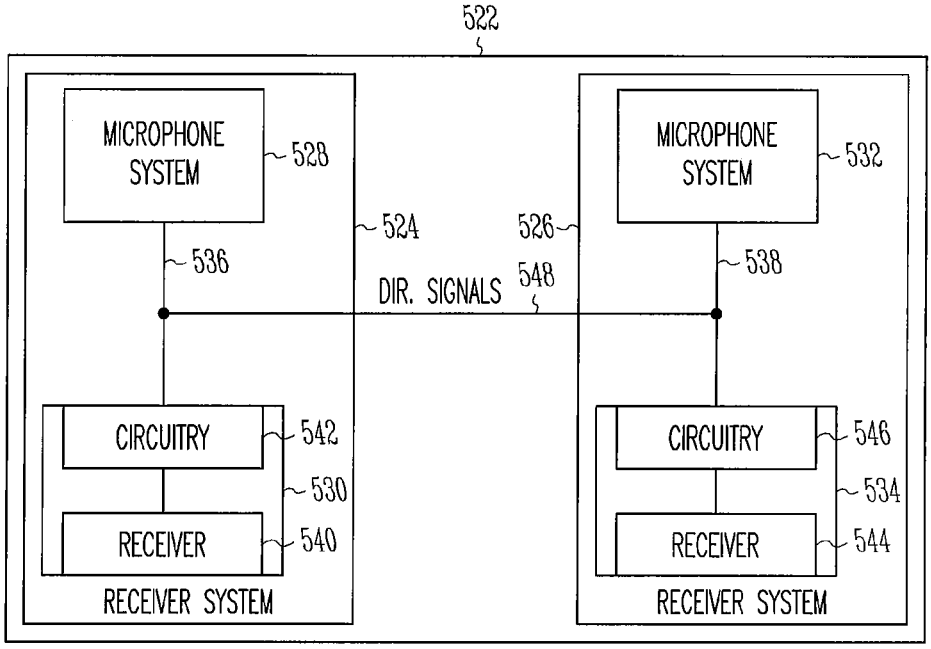
FIG. 5 illustrates one embodiment of a hearing aid system that diotically presents second-order gradient directional hearing aid signals.

FIG. 5 illustrates one embodiment of a hearing aid system that diotically presents second-order gradient directional hearing aid signals. The illustrated system 522 includes a first hearing aid device 524 (such as may be located to aid a left ear of a wearer) and a second hearing aid device 526 (such as may be located to aid a right ear of the wearer). The illustrated first hearing aid device 524 includes a first microphone system 528 and a first receiver circuit 530; and the illustrated second hearing aid device 526 includes a second microphone system 532 and a second receiver circuit 534. The first microphone system 528 receives sound, and provides a first output signal representative of the sound received on line 536. The second microphone system 532 receives sound, and provides a second output signal representative of the sound received on line 538. Both the first and the second microphone systems include a directional microphone system. As such, both the first and the second output signals are capable of including a first-order gradient directional hearing aid signal.

As will be discussed in more detail below with respect to FIGS. 8 and 9, various embodiments of the first and the second microphone systems are also capable of producing omnidirectional (or non-directional) signals. In these embodiments, the wearer of the hearing aid system is able to select a directional mode of operation and an omnidirectional mode of operation as desired for the wearer's listening situation and environment.

The illustrated first receiver circuit 530 includes a first receiver 540 for providing sound to aid hearing, and a signal processing circuit 542 for receiving the first output signal from the first microphone system 528, and providing a first processed signal representative of the sound received to the first receiver 540. The illustrated second receiver circuit 534 includes a second receiver 544 for providing sound to aid hearing, and a signal processing circuit 546 for receiving the second output signal from the second microphone system 532, and providing a second processed signal representative of the sound received to the second receiver 544. One embodiment of the processing circuitry 542 includes conventional amplifier and hearing aid circuitry for processing hearing aid signals for a receiver.

In the illustrated hearing aid system 522, the output of the first microphone system 528 is connected to the output of the second microphone system 532 via line 548, which forms a summing node for the first output signal and the second output signal. In one embodiment, line 548 is a physical conductor or cable that extends from the first hearing aid device to the second hearing aid device.

The first-order gradient directional hearing aid signals provided as the output signals from the first and the second microphone systems are summed together to provide a second-order gradient directional signal. This second-order gradient directional signal is simultaneously presented to the first receiver circuit 530 and the second receiver circuit 534. This results in a simultaneous presentation of the same sound to each ear (i.e. a diotic presentation). Thus, the illustrated hearing aid system 522 is capable of diotically presenting a second-order gradient directional hearing aid signal that has an expected directivity index of about 9 dB.

Figure 6:
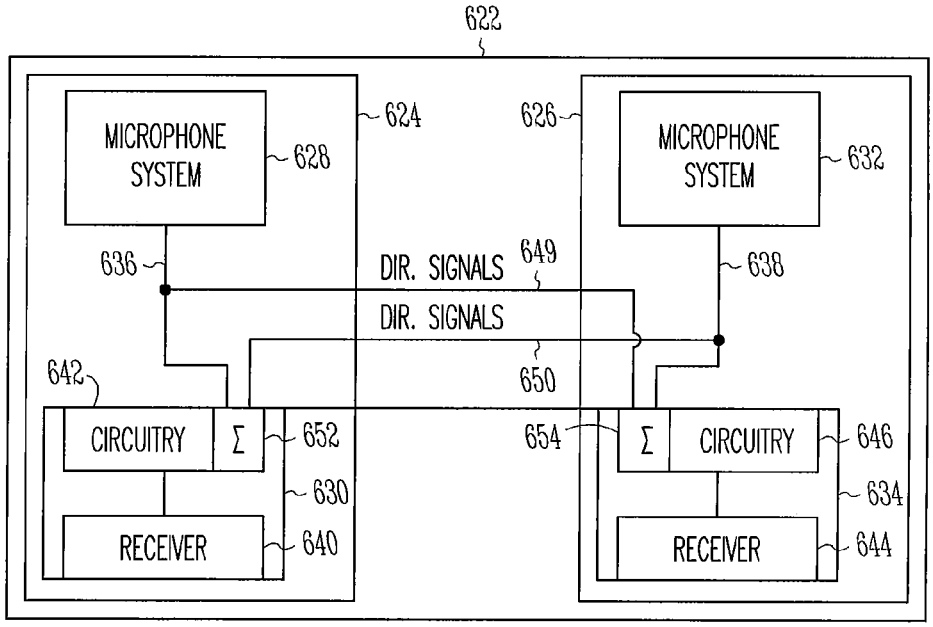
FIG. 6 illustrates another embodiment of a hearing aid system that diotically presents second-order gradient directional hearing aid signals.

FIG. 6 illustrates another embodiment of a hearing aid system that diotically presents second-order gradient directional hearing aid signals. The illustrated system 622 includes a first hearing aid device 624 (such as may be located to aid a left ear of a wearer) and a second hearing aid device 626 (such as may be located to aid a right ear of the wearer). The illustrated first hearing aid device 624 includes a first microphone system 628 and a first receiver circuit 630; and the illustrated second hearing aid device 626 includes a second microphone system 632 and a second receiver circuit 634. The first microphone system 628 receives sound, and provides a first output signal representative of the sound received on line 636. The second microphone system receives sound, and provides a second output signal representative of the sound received on line 638. Both the first and the second microphone systems include a directional microphone system. As such, both the first and the second output signals are capable of including a first-order gradient directional hearing aid signal.

The illustrated first receiver circuit 630 includes a first receiver 640 for providing sound to aid hearing, and a signal processing circuit 642 for receiving the first output signal from the first microphone system 628, and providing a first processed signal representative of the sound received to the first receiver 640. The illustrated second receiver circuit 634 includes a second receiver 644 for providing sound to aid hearing, and a signal processing circuit 646 for receiving the second output signal from the second microphone system 632, and providing a second processed signal representative of the sound received to the second receiver 644.

In the illustrated system, the first signal processing circuit 642 includes a first summing module 652; and the second signal processing circuit 646 includes a second summing module 654. The first summing module 652 combines the first directional output signal on line 636 and the second directional output signal on line 650. The second summing module 654 combines the first directional output signal on line 649 and the second directional output signal on line 638. The summing modules 652 and 654 provide the ability to appropriately match the first and second directional output signals and/or to perform other signal processing. One embodiment of summing circuitry is shown and described with respect to FIG. 7. In one embodiment, lines 649 and 650 form at least one physical conductor that extends from the first hearing aid device to the second hearing aid device. Various embodiments include analog and digital transmission systems.

Figure 7:
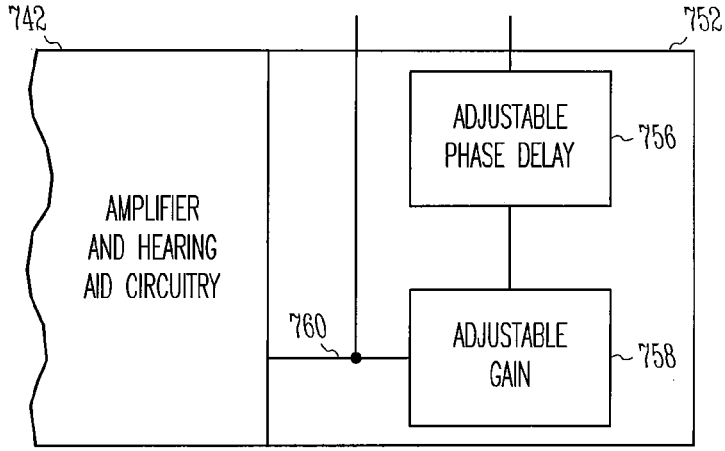
FIG. 7 illustrates one embodiment of summing circuitry that provides part of the amplifier and hearing aid circuitry illustrated in the embodiment of FIG. 6.

FIG. 7 illustrates one embodiment of summing circuitry that provides part of the amplifier and hearing aid circuitry illustrated in the embodiment of FIG. 6. One embodiment of the summing circuitry 752 includes a phase delay module 756 and a gain module 758. One embodiment of the summing circuitry includes an adjustable phase delay module and an adjustable gain module. These modules function to adjust the phase and gain of at least one of the directional output signals, after which the directional output signals are combined at summing node 760 and presented to the remainder of the processing circuitry 742 of the receiver circuit. Thus, these modules 756 and 758 function to compensate for slightly mismatched directional signals to achieve a desired second-order polar pattern.

Figure 8:
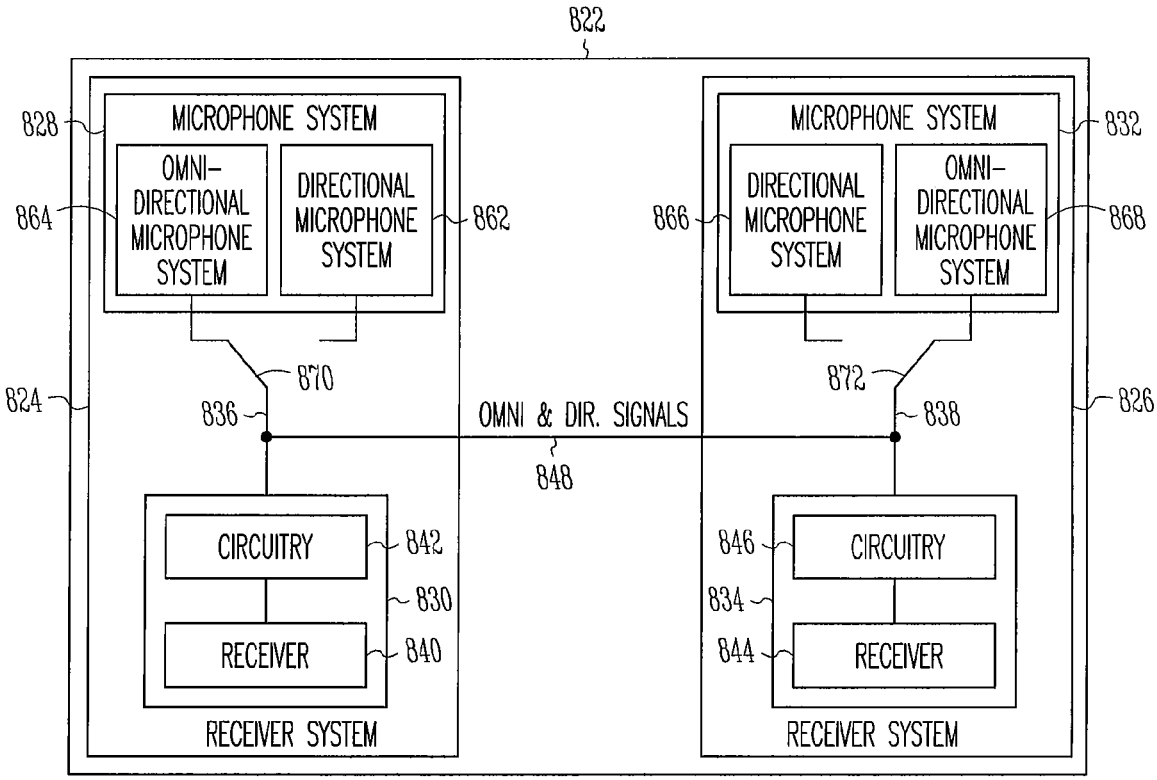
FIG. 8 illustrates another embodiment of a hearing aid system that diotically presents second-order gradient directional hearing aid signals.

FIG. 8 illustrates another embodiment of a hearing aid system that diotically presents second-order gradient directional hearing aid signals. The illustrated system 822 includes a first hearing aid device 824 (such as may be located to aid a left ear of a wearer) and a second hearing aid device 826 (such as may be located to aid a right ear of the wearer). The illustrated first hearing aid device 824 includes a first microphone system 828 and a first receiver circuit 830; and the illustrated second hearing aid device 826 includes a second microphone system 832 and a second receiver circuit 834. The first microphone system 824 receives sound, and provides a first output signal representative of the sound received on line 836. The second microphone system 832 receives sound, and provides a second output signal representative of the sound received on line 838.

The first microphone system 828 includes a directional microphone system 862 and an omnidirectional microphone system 864; and the second microphone system 832 includes a directional microphone system 866 and an omnidirectional microphone system 868. In one embodiment, both the first and the second microphone systems 828 and 832 include a switch-selectable directional-omnidirectional microphone system for providing a directional mode of operation in which the first-order gradient directional hearing aid signal is produced, and an omnidirectional mode of operation in which an omnidirectional signal is produced. In this embodiment, the switch-selectable directional-omnidirectional microphone system effectively forms the illustrated omnidirectional microphone system and the directional microphone system 864 and 868 for the first and the second hearing aid devices 824 and 826, respectively. The wearer of the hearing aid system is able to select a directional mode of operation and an omnidirectional mode of operation as desired for the wearer's listening situation and environment.

In the illustrated hearing aid system, the output of the first microphone system 828 is connected to the output of the second microphone system 832 via line 848, which forms a summing node for the first output signal and the second output signal. The illustrated switches 870 and 872 are positioned between the line 848 and the microphone systems such that both omnidirectional and directional signals are capable of being summed and diotically presented to the receiver circuits 830 and 834 in the first and the second hearing aid devices 824 and 826, respectively. In one embodiment, line 848 is a physical conductor or cable that extends from the first hearing aid device to the second hearing aid device. Other embodiments include wireless communication. When the switches are positioned to select a directional mode of operation, the first-order gradient directional hearing aid signals provided as the output signals from the first and the second directional microphone systems 862 and 866 are summed together to provide a second-order gradient directional signal that is diotically presented to the receiver circuits 830 and 834 in the first and the second hearing aid devices 824 and 826, respectively.

Figure 9:
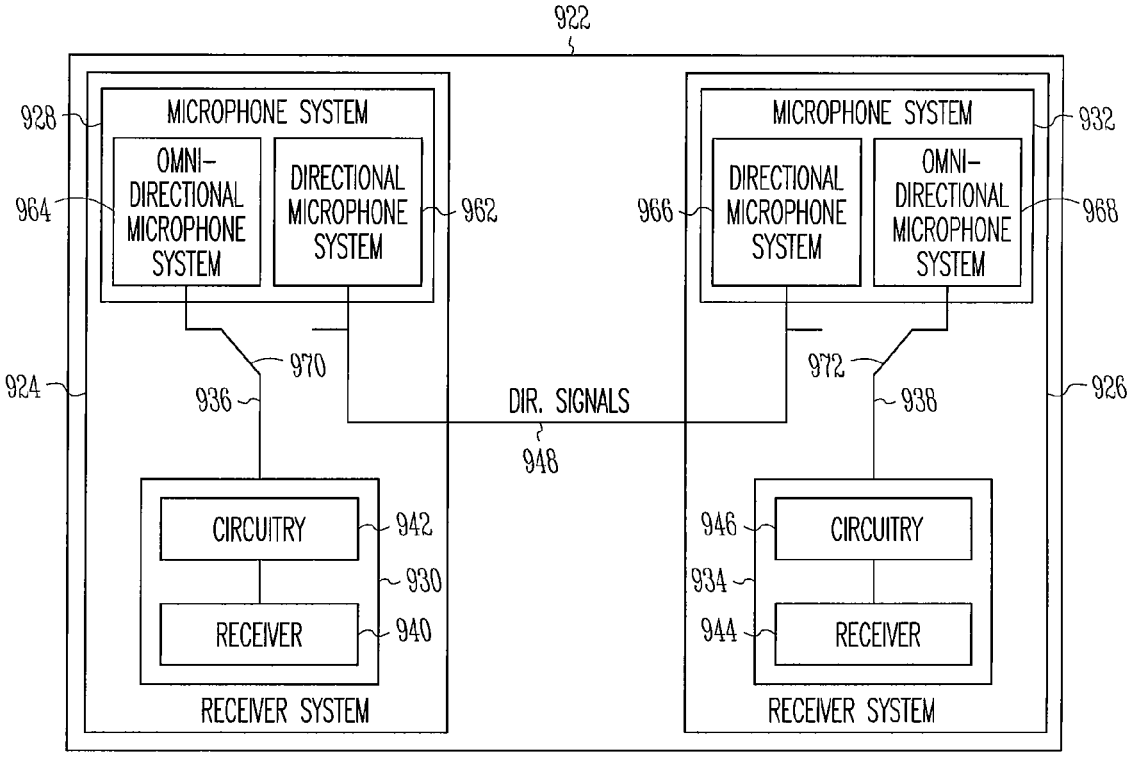
FIG. 9 illustrates another embodiment of a hearing aid system that diotically presents second-order gradient directional hearing aid signals.

FIG. 9 illustrates another embodiment of a hearing aid system that diotically presents second-order gradient directional hearing aid signals. The illustrated system 922 includes a first hearing aid device 924 (such as may be located to aid a left ear of a wearer) and a second hearing aid device 926 (such as may be located to aid a right ear of the wearer). The illustrated first hearing aid device 924 includes a first microphone system 928 and a first receiver circuit 930; and the illustrated second hearing aid device 926 includes a second microphone system 932 and a second receiver circuit 934. The first microphone system 928 receives sound, and provides a first output signal representative of the sound received on line 936. The second microphone system 932 receives sound, and provides a second output signal representative of the sound received on line 938.

The first microphone system 928 includes a directional microphone system 962 and an omnidirectional microphone system 964; and the second microphone system 932 includes a directional microphone system 966 and an omnidirectional microphone system 968. In one embodiment, both the first and the second microphone systems 928 and 932 include a switch-selectable directional-omnidirectional microphone system for providing a directional mode of operation in which the first-order gradient directional hearing aid signal is produced, and an omnidirectional mode of operation in which an omnidirectional signal is produced. In this embodiment, the switch-selectable directional-omnidirectional microphone system effectively forms the illustrated omnidirectional microphone system 964 and 968 and the directional microphone system 962 and 966 for the first and the second hearing aid devices 924 and 926, respectively. The wearer of the hearing aid system is able to select a directional mode of operation and an omnidirectional mode of operation as desired for the wearer's listening situation and environment.

In the illustrated hearing aid system 922, the output of the first directional microphone system 962 is connected to the output of the second directional microphone system 966 via line 948, which forms a summing node for the first output signal and the second output signal. The illustrated switches 970 and 972 are positioned such that only the directional signals from the first and the second directional microphone systems 962 and 966 are capable of being summed and diotically presented to the receiver circuits 930 and 934 in the first and the second hearing aid devices 924 and 926, respectively. In one embodiment, line 948 is a physical conductor or cable that extends from the first hearing aid device 924 to the second hearing aid device 926. Other embodiments include wireless communication.

When the switches are positioned to select a directional mode of operation, the first-order gradient directional hearing aid signals provided as the output signals from the first and the second directional microphone systems 962 and 966 are summed together to provide a second-order gradient directional signal that is diotically presented to the receiver circuits 930 and 934 in the first and the second hearing aid devices 924 and 926. When the switches are positioned to select an omnidirectional mode of operation, the omnidirectional signal from the first omnidirectional microphone system 964 is presented to the first receiver circuit 930, and the omnidirectional signal from the second omnidirectional microphone system 968 is presented to the second receiver circuit 934.

Figure 10:
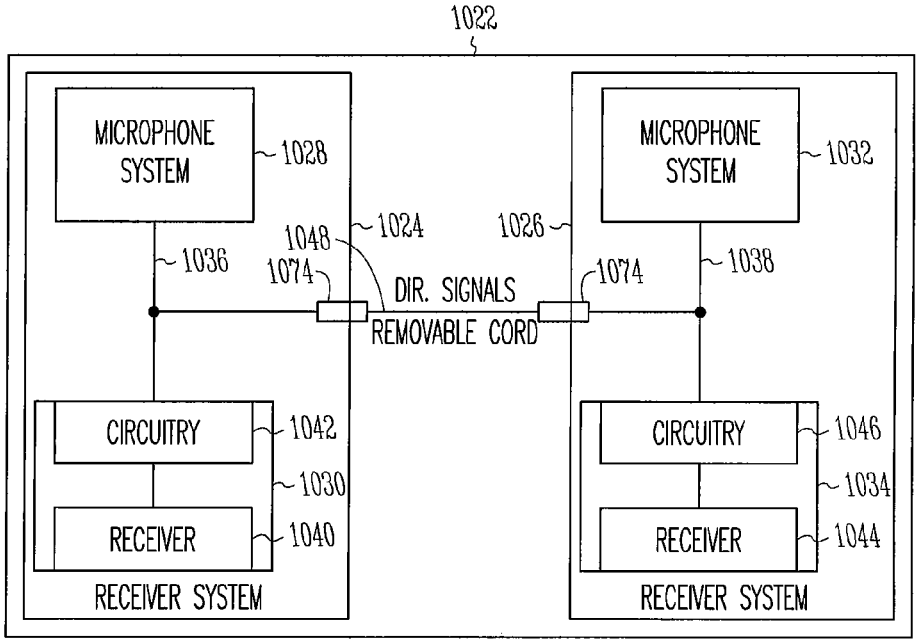
FIG. 10 illustrates another embodiment of a hearing aid system that diotically presents second-order gradient directional hearing aid signals.

FIG. 10 illustrates another embodiment of a hearing aid system that diotically presents second-order gradient directional hearing aid signals. The illustrated hearing aid system 1022 is similar to that earlier shown and described with respect to FIG. 5. This embodiment of the hearing aid system includes a removable cord 1048 that extends between the first hearing aid system 1024 and the second hearing aid system 1026. In the illustrated embodiment, both the first and the second the second hearing aid devices have sockets 1074 into which the removable cord 1048 is plugged.

When both hearing aid devices 1024 and 1026 are functioning in a directional mode of operation to produce a first-order gradient directional signal, and when the cord 1048 is attached between the hearing aid devices 1024 and 1026, the output signals from the first and the second directional microphone systems are summed together to provide a second-order gradient directional signal that is diotically presented to the receiver circuits 1030 and 1034 in the first and the second hearing aid devices 1024 and 1026, respectively. When the cord 1048 is removed and both hearing aid devices 1024 and 1026 are functioning in a directional mode of operation, the first microphone system 1028 presents one first-order gradient signal to the first receiver circuit 1030, and the second microphone system 1032 independently presents another first-order gradient signal to the second receiver circuit 1034.

In one embodiment, each of the illustrated hearing aid devices 1024 and 1026 is capable of functioning in an omnidirectional mode of operation. When both hearing aid devices 1024 and 1026 are functioning in an omnidirectional mode of operation to produce an omnidirectional signal and when the cord 1048 is attached between the hearing aid devices, the output signals from the first and second microphone system are summed together and are diotically presented to the first and the second receiver circuits 1030 and 1034. When both hearing aid devices 1024 and 1026 are functioning in an omnidirectional mode of operation and when the cord 1048 is not attached between the hearing aid devices, the first microphone system 1028 presents one omnidirectional signal to the first receiver circuit 1030 and the second microphone system 1032 independently presents another omnidirectional signal to the second receiver circuit 1034.

Figure 11:
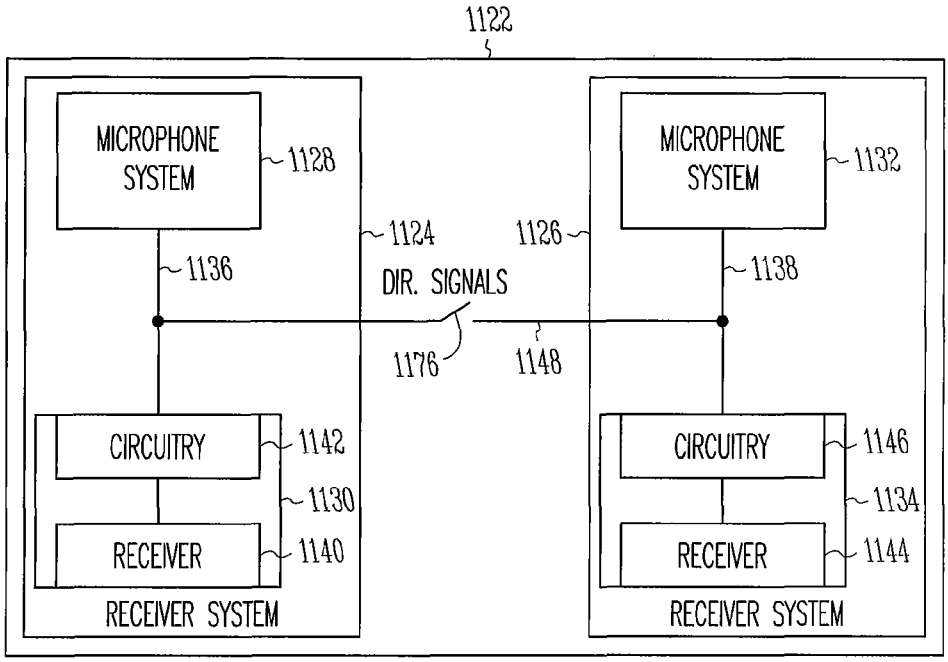
FIG. 11 illustrates another embodiment of a hearing aid system that diotically presents second-order gradient directional hearing aid signals.

FIG. 11 illustrates another embodiment of a hearing aid system that diotically presents second-order gradient directional hearing aid signals. The illustrated hearing aid system 1122 is similar to that earlier shown and described with respect to FIG. 5. This embodiment of the hearing aid system includes a switch 1176 that disconnects the first hearing aid device 1124 from the second hearing aid device 1126.

When both hearing aid devices 1124 and 1126 are functioning in a directional mode of operation to produce a first-order gradient directional signal, and when the switch 1176 is closed to provide an electrical connection between the hearing aid devices through line 1148, the output signals from the first and the second microphone systems 1128 and 1132 are summed together to provide a second-order gradient directional signal that is diotically presented to the receiver circuits 1130 and 1134 in the first and the second hearing aid devices 1124 and 1126, respectively. When the switch 1176 is opened to disconnect the first hearing aid device from the second hearing aid device 1126 and both hearing aid devices are functioning in a directional mode of operation, the first microphone system 1128 presents one first-order gradient signal to the first receiver circuit 1130, and the second microphone system 1132 independently presents another first-order gradient signal to the second receiver circuit 1134.

In one embodiment, each of the illustrated hearing aid devices 1124 and 1126 is capable of functioning in an omnidirectional mode of operation. When both hearing aid devices are functioning in an omnidirectional mode of operation to produce an omnidirectional signal and when the switch 1176 is closed, the output signals from the first and second microphone systems 1128 and 1132 are summed together and a resultant signal is diotically presented to the first and the second receiver circuits. The resultant signal has an improved signal-to-noise ratio as compared to one of the omnidirectional signals. Summing the omnidirectional output signals together increases the signal by about 6 dB, and only increases the noise by about 3 dB. When both hearing aid devices are functioning in an omnidirectional mode of operation and when the switch 1176 is opened, the first microphone system 1128 presents one omnidirectional signal to the first receiver circuit 1130 and the second microphone system 1132 independently presents another omnidirectional signal to the second receiver circuit 1134.

Figure 12:
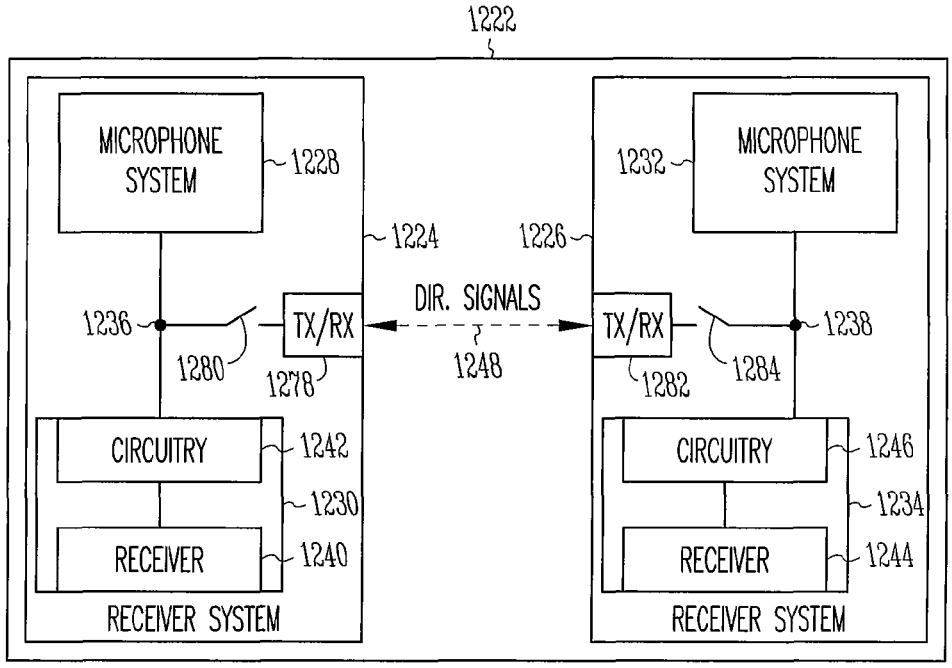
FIG. 12 illustrates another embodiment of a hearing aid system that diotically presents second-order gradient directional hearing aid signals.

FIG. 12 illustrates another embodiment of a hearing aid system that diotically presents second-order gradient directional hearing aid signals. The illustrated hearing aid system 1222 is similar to that earlier shown and described with respect to FIG. 5. In this embodiment of the hearing aid system, the first hearing aid device 1224 includes a first transceiver (Tx/Rx) 1278 connected to the output of the first microphone system through switch 1280, and the second hearing aid device 1226 includes a second transceiver (Tx/Rx) 1282 connected to the output of the second microphone system through switch 1284. The first and the second transceivers are used to provide two-way wireless communication, as illustrated by line 1248, between the first and the second hearing aid devices.

When both hearing aid devices 1224 and 1226 are functioning in a directional mode of operation to produce a first-order gradient directional signal, and when the switches 1280 and 1284 are closed to provide an electrical connection to the transceivers, the output signals from the first and the second microphone systems are summed together at nodes 1236 and 1238 to provide a second-order gradient directional signal that is diotically presented to the receiver circuits 1230 and 1234 in the first and the second hearing aid devices 1224 and 1226, respectively. When the switches 1280 and 1284 are opened to disconnect the transceivers and both hearing aid devices are functioning in a directional mode of operation, the first microphone system 1228 presents one first-order gradient signal to the first receiver circuit 1230, and the second microphone system 1232 independently presents another first-order gradient signal to the second receiver circuit 1234.

In one embodiment, each of the illustrated hearing aid devices is capable of functioning in an omnidirectional mode of operation. When both hearing aid devices are functioning in an omnidirectional mode of operation to produce an omnidirectional signal and when the switches 1280 and 1284 are closed, the output signals from the first and second microphone system are summed together at nodes 1236 and 1238, and the resultant signal is diotically presented to the first and the second receiver circuits 1230 and 1234. The resultant signal has an improved signal-to-noise ratio as compared to one of the omnidirectional signals. Summing the omnidirectional output signals together increases the signal by about 6 dB, and only increases the noise by about 3 dB. When both hearing aid devices are functioning in an omnidirectional mode of operation and when the switches 1280 and 1284 are opened, the first microphone system 1228 presents one omnidirectional signal to the first receiver circuit 1230 and the second microphone system 1232 independently presents another omnidirectional signal to the second receiver circuit 1234. According to various embodiments, the wireless communication includes, but is not limited to, inductance and RF transmissions. According to various embodiments, the wireless communication involves analog and digital signal processing.

Figure 13:
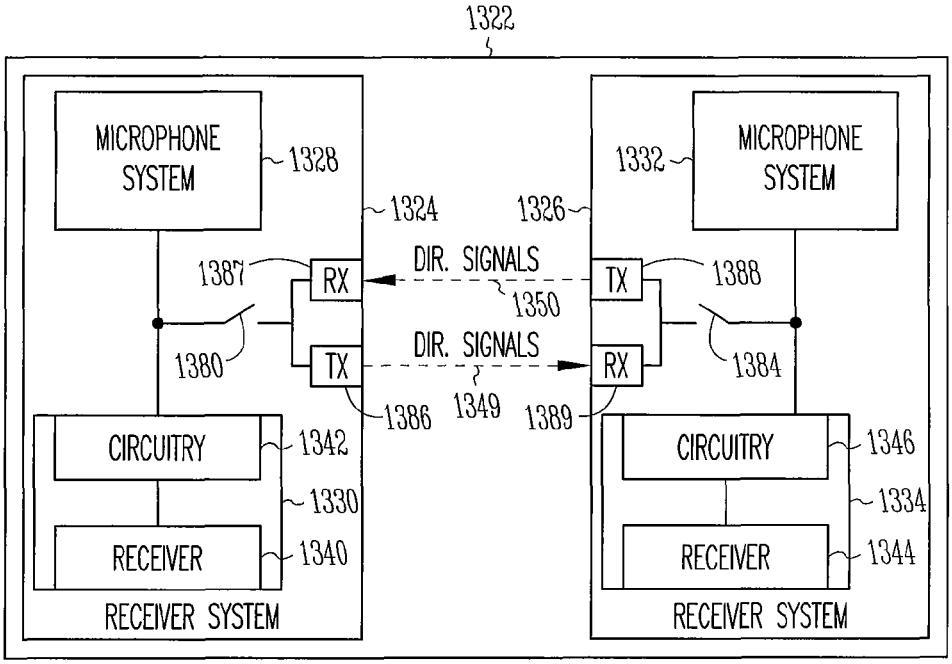
FIG. 13 illustrates another embodiment of a hearing aid system that diotically presents second-order gradient directional hearing aid signals.

FIG. 13 illustrates another embodiment of a hearing aid system that diotically presents second-order gradient directional hearing aid signals. The illustrated hearing aid system 1322 is similar to that earlier shown and described with respect to FIG. 12. In this embodiment of the hearing aid system, the first hearing aid device 1324 includes a first transmitter (Tx) 1386 and a first receiver (Rx) 1387 both connected to the output of the first microphone system 1328 through switch 1380, and the second hearing aid device 1326 includes a second transmitter (Tx) 1388 and a second receiver (Rx) 1389 both connected to the output of the second microphone system 1332 through switch 1384. The illustrated transmitters and receivers are used to provide two one-way wireless communication, as illustrated by line 1349 and 1350, between the first and the second hearing aid devices. In one embodiment, a one-way wireless link is provided using inductive transmission with a relatively simple tuned circuit on the transmitting side and an off-the-shelf amplitude modulated receiver in the receiving hearing aid side. One example of an off-the-shelf amplitude modulated receiver is the Ferranti ZN414Z receiver. Two one-way wireless links operating at different frequencies are capable of being employed as a two-way wireless link. Digital signal processing also can be used to code each one-way signal in a two-way wireless link.

Figure 14:
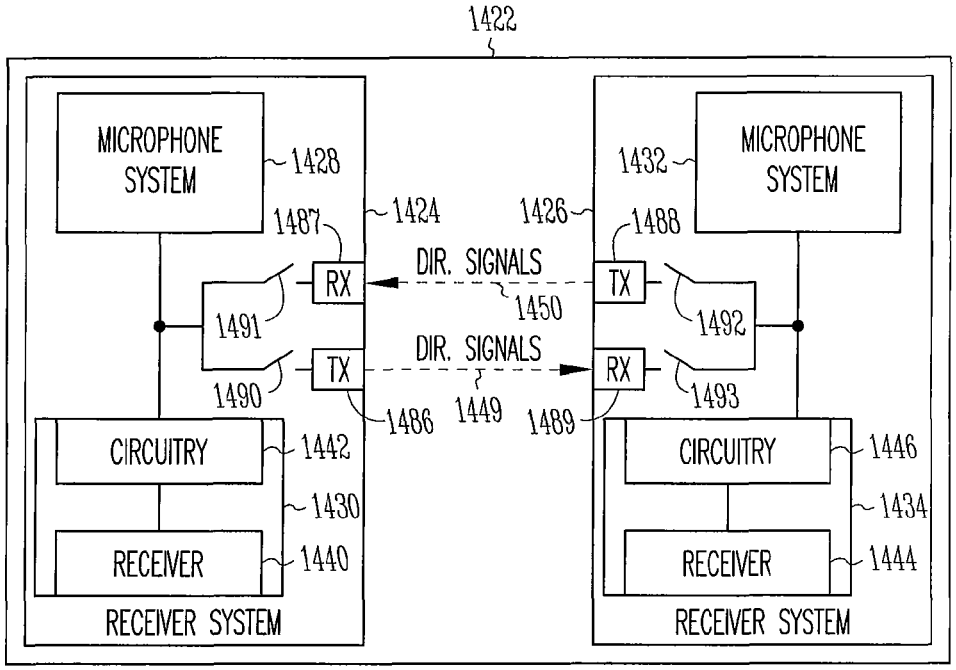
FIG. 14 illustrates another embodiment of a hearing aid system that diotically presents second-order gradient directional hearing aid signals.

FIG. 14 illustrates another embodiment of a hearing aid system that diotically presents second-order gradient directional hearing aid signals. The illustrated hearing aid system 1422 is similar to that earlier shown and described with respect to FIG. 13. In this embodiment of the hearing aid system, the first hearing aid device 1424 includes a first transmitter (Tx) 1486 connected to the output of the first microphone system through switch 1490, and a first receiver (Rx) 1487 connected to the output of the first microphone system 1428 through switch 1491. The second hearing aid device 1426 includes a second transmitter (Tx) 1488 connected to the output of the second microphone system 1432 through switch 1492, and a second receiver (Rx) 1489 connected to the output of the second microphone system 1432 through switch 1493. The illustrated transmitters and receivers are used to provide two one-way wireless communication, as illustrated by line 1449 and 1450, between the first and the second hearing aid devices. In one embodiment, a one-way wireless link is provided using inductive transmission with a relatively simple tuned circuit on the transmitting side and an off-the-shelf amplitude modulated receiver in the receiving hearing aid side. One example of an off-the-shelf amplitude modulated receiver is the Ferranti ZN414Z receiver. The switches provide a user with additional control to provide a second-order gradient directional signal to one of the two hearing aid devices, for example. Two one-way wireless links operating at different frequencies are capable of being employed as a two-way wireless link. Digital signal processing also can be used to code each one-way signal in a two-way wireless link.

Figure 15:
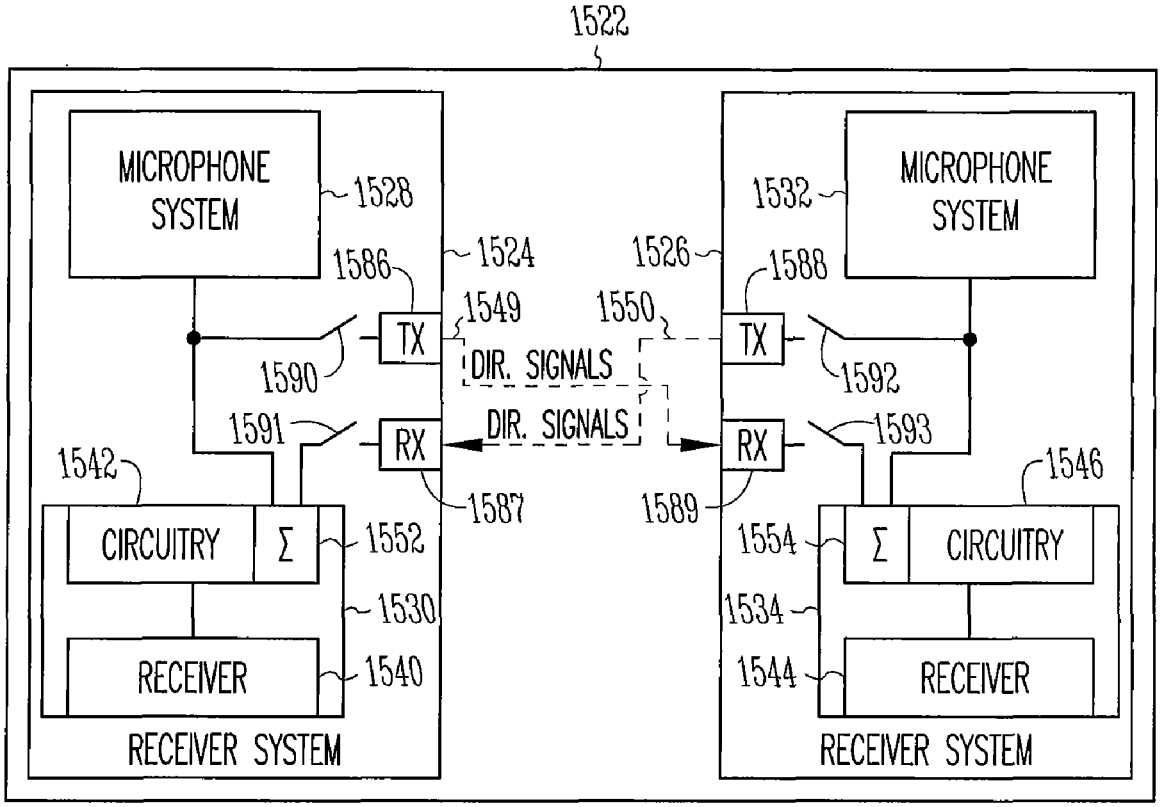
FIG. 15 illustrates another embodiment of a hearing aid system that diotically presents second-order gradient directional hearing aid signals.

FIG. 15 illustrates another embodiment of a hearing aid system that diotically presents second-order gradient directional hearing aid signals. The illustrated hearing aid system 1522 is similar to that earlier shown and described with respect to FIG. 14. In this embodiment of the hearing aid system, the first hearing aid device 1524 includes a first transmitter (Tx) 1586 connected to the output of the first microphone system 1528 through switch 1590, and a first receiver (Rx) 1587 connected to a first summing module 1552 in the first receiver circuit 1530 through switch 1591. The second hearing aid device 1526 includes a second transmitter (Tx) 1588 connected to the output of the second microphone system 1532 through switch 1593, and a second receiver (Rx) 1589 connected to a second summing module 1554 in the second receiver circuit 1534 through switch 1593. In one embodiment, the first and the second summing module 1552 and 1554 include an adjustable phase delay module and an adjustable gain module as shown and described earlier with respect to FIG. 7. The illustrated transmitters and receivers are used to provide two one-way wireless communication, as illustrated by line 1549 and 1550, between the first and the second hearing aid devices. When both hearing aid devices are functioning in a directional mode of operation to produce a first-order gradient directional signal, and when the switches 1590, 1591, 1592, 1593 are closed to provide an electrical connection to the transmitters and receivers, the output signals from the first and the second directional microphone systems are summed together in the first and the second summing modules 1552 and 1553 to provide a second-order gradient directional signal that is diotically presented to the receivers 1540 and 1544 in the first and the second hearing aid devices 1524 and 1526, respectively. In one embodiment, a one-way wireless link is provided using inductive transmission with a relatively simple tuned circuit on the transmitting side and an off-the-shelf amplitude modulated receiver in the receiving hearing aid side. One example of an off-the-shelf amplitude modulated receiver is the Ferranti ZN414Z receiver. The switches provide a user with additional control to provide a second-order gradient directional signal to one of the two hearing aid devices, for example. Two one-way wireless links operating at different frequencies are capable of being employed as a two-way wireless link. Digital signal processing also can be used to code each one-way signal in a two-way wireless link.

One of ordinary skill in the art will understand, upon reading and comprehending this disclosure, that various embodiments of the present subject matter include various elements form one or more of the embodiments shown and described with respect to FIGS. 5-15.

According to various embodiments, the microphone systems illustrated in FIGS. 5-6 and 8-15 include an omnidirectional microphone system for producing an omnidirectional output signal representative of a sound received by the omnidirectional microphone system, and a directional microphone system for producing a directional output signal representative of a sound received by the directional microphone system. According to various embodiments, these microphone systems include a switch-selectable directional-omnidirectional microphone that provides the functions of the directional and the omnidirectional microphone systems. One example of a switch-selectable directional-omnidirectional microphone is a single-cartridge acoustic directional-omnidirectional microphone such as the Microtronic 6903. Another example of a switch-selectable directional-omnidirectional microphone is a switch-selectable, electrically-summed dual-omnidirectional directional microphone system, such as that provided in U.S. Pat. No. 5,757,933 and U.S. patent application Ser. No. 09/052,631, filed on Mar. 31, 1998, both of which are assigned to Applicants' assignee and are hereby incorporated by reference their entirety. Embodiments for a switch-selectable, electrically-summed dual-omnidirectional directional microphone system are provided below with respect to FIGS. 16 and 17.

Figure 16:
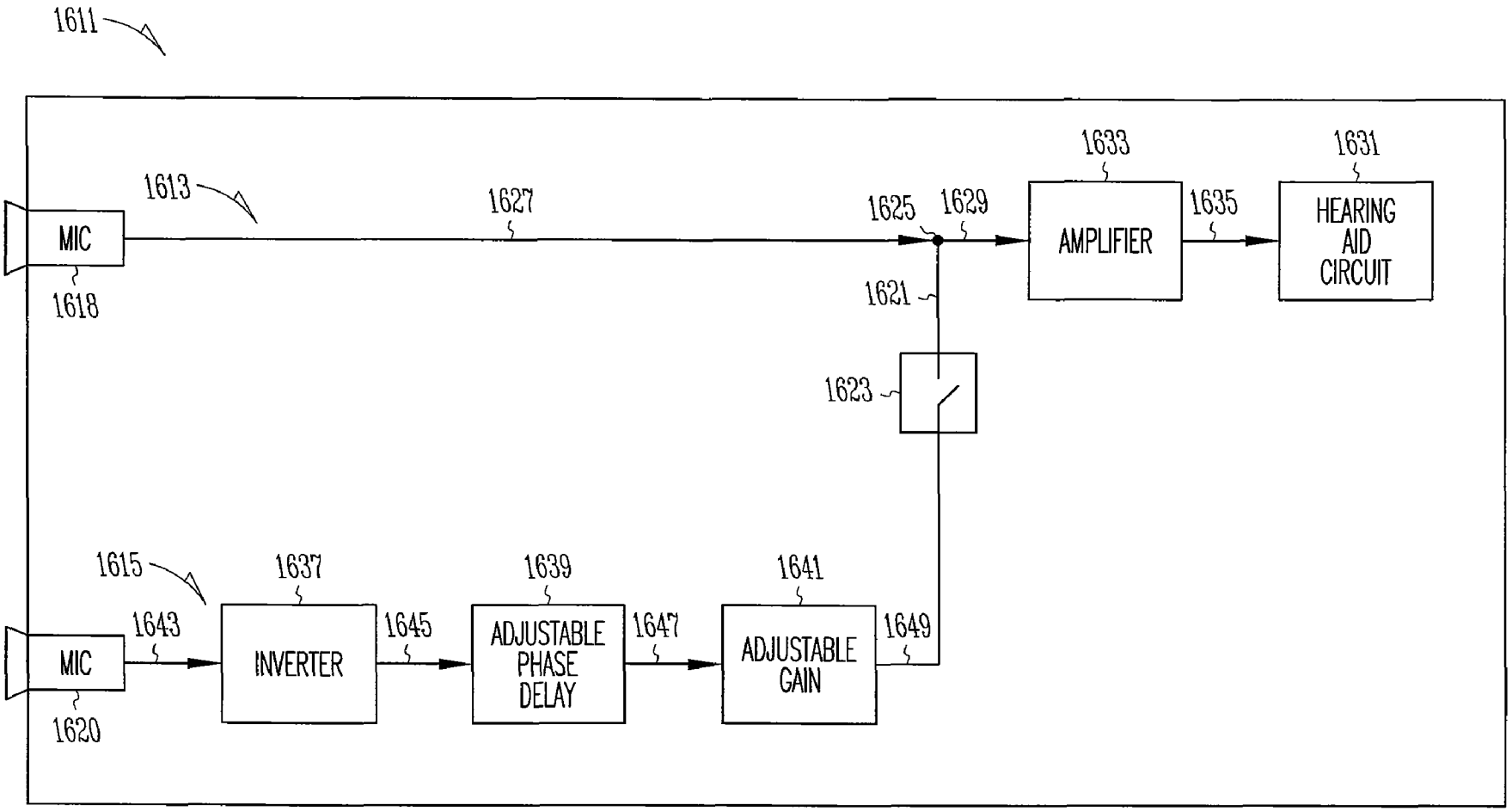
FIG. 16 illustrates a block diagram of one embodiment of a switch-selectable directional-omnidirectional microphone system for the hearing aid system.

FIG. 16 illustrates a block diagram of one embodiment of a switch-selectable directional-omnidirectional microphone system for the hearing aid system. The directional microphone system 1611 utilizes two non-directional microphone circuits to achieve a directional microphone signal. The directional microphone system 1611 includes a first non-directional microphone system 1613 and a second non-directional microphone system 1615.

The position of the first and the second microphone systems in one embodiment of a hearing aid system is illustrated in FIG. 3. Microphone 318 and microphone 320 include inlet tubes, which protrude through the in-the-ear hearing aid face plate 360. The microphones 318 and 320 are spaced a relatively short distance apart, preferably less than ½ inch. In one embodiment, the microphones 318 and 320 are preferably ⅓ of an inch apart.

The axis of directionality is defined by a line drawn through the inlet tubes, indicated at 319. The in-the-ear hearing aid is of a molded design such that the axis of directionality 319 is relatively horizontal to the floor when the in-the-ear hearing aid is positioned within the hearing aid wearer's ear and the wearer is in an upright sitting or standing position. This design achieves desirable directional performance of the in-the ear hearing aid.

Referring again to FIG. 16, in one embodiment, the output signals from the second non-directional microphone system 1615 (indicated by signal 1621) is electrically coupled through switch 1623, and summed at node 1625 with the first non-directional microphone system 1613 (indicated by signal 1627). The resulting output signal is indicated at 1629. The output signal 1629 is electrically coupled to a hearing aid circuit 1631. For example, various embodiments of the hearing aid circuit 1631 include a linear circuit, a compression circuit, an adaptive high-pass filter, and a high-power output stage.

In one embodiment, the output signal 1625 from the first non-directional microphone system 1613 and second non-directional microphone system 1615 is amplified by passing it through an amplifier 1133. The resulting output signal of amplifier 163, indicated at 1635, is coupled to the hearing aid circuit 1631. The amplifier 1633 and the hearing aid circuit 1131 form a processing circuit in a receiver circuit as described previously.

The in-the-ear hearing aid 16 is switched between a non-directional mode and a directional mode through the operation of switch 1623. In the non-directional mode, switch 1623 is open (as shown), and non-directional microphone 1618 feeds directly in hearing aid circuit 1631. For operation in a directional mode, switch 1623 is closed, and the first non-directional microphone system 1311 and second non-directional microphone system 1615 output signals 1627 and 1621 are summed at summing node 1625, with the resulting output signal 1627 being coupled to hearing aid circuit 1631.

In one embodiment, the second non-directional microphone system 1615 includes non-directional microphone 1620, an inverter 1637, an adjustable pulse delay module 1639, and an adjustable gain module 1641. The output signal of microphone 1620 is coupled to inverter 1637, indicated at 1643. The output signal of inverter 1637 is coupled to the adjustable pulse delay module 1639, indicated at 1645. The output of adjustable phase delay module 1639 is coupled to the adjustable gain module 1641, indicated at 1647. The output of the adjustable gain module 1641 is coupled to switch 1623, indicated at 1649.

The output signal 1643 of microphone 1620 is inverted by inverter 1637. Further, in one embodiment, when switch 1623 is closed, the phase delay of the output of microphone 1620 may be adjusted relative to the output of microphone 1618. Similarly, adjustable gain module 1641 adjusts the amplitude of the output signal received from microphone 1620 relative to the output signal 1627 from microphone 1618. By providing such adjustment, the hearing aid manufacturer and/or the hearing aid dispenser is able to vary the polar directivity pattern of the in-the-ear hearing aid. The adjustable non-directional microphone system 1615 allows the polar pattern to be adjusted to compensate for small ears which do no allow larger inlet spacing. Further, the adjustable non-directional microphone system 1615 allows for adjustments to compensate for the differences in manufacturing tolerances between non-directional microphone 1618 and non-directional microphone 1620.

Figure 17:
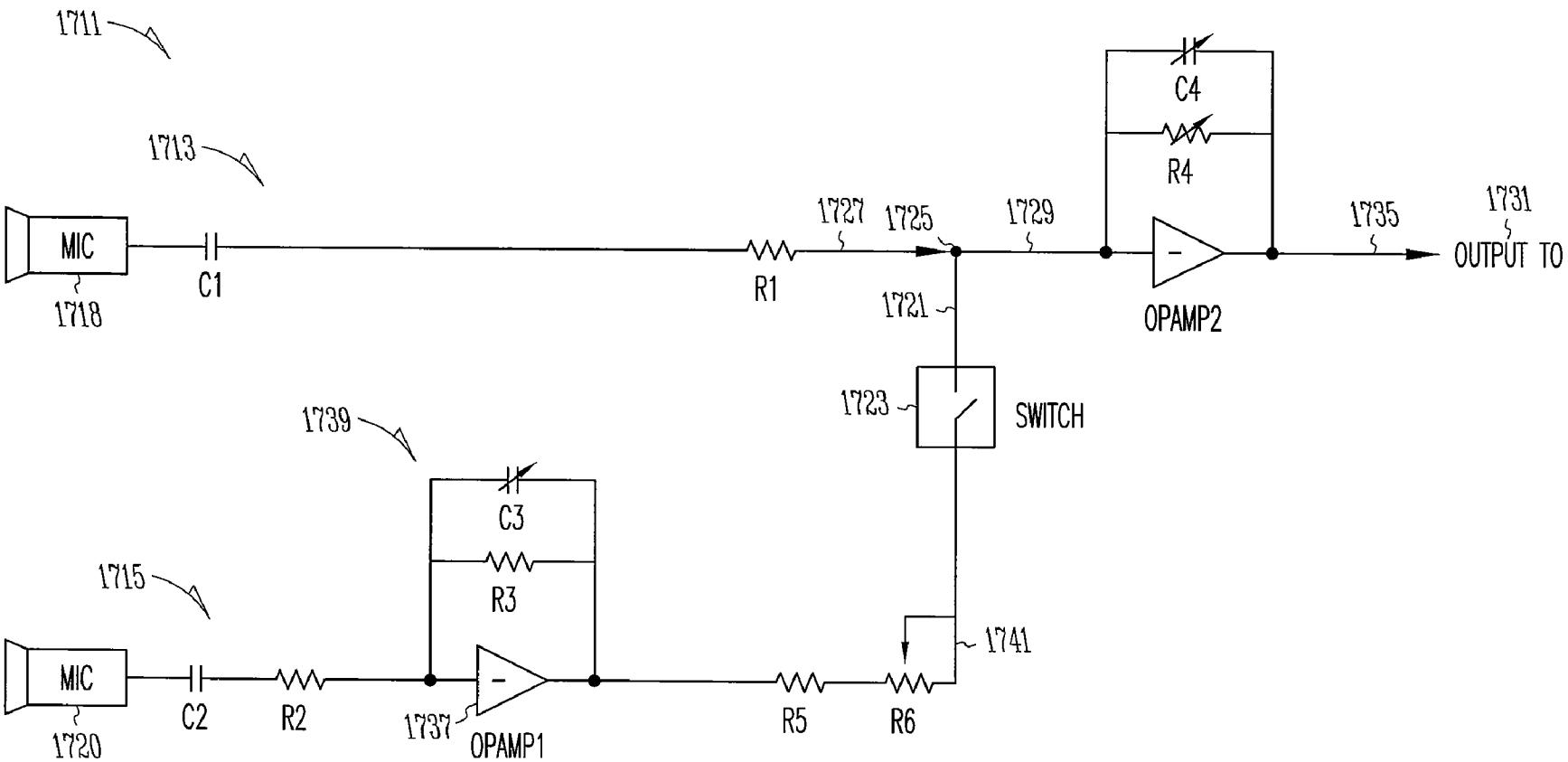
FIG. 17 illustrates a schematic diagram of one embodiment of a switch-selectable directional-omnidirectional microphone system for the hearing aid system.

FIG. 17 illustrates a schematic diagram of one embodiment of a switch-selectable directional-omnidirectional microphone system 1711 for the hearing aid system. Non-directional microphone 1718 has a coupling capacitor C1 coupled to its output. Resistor R1 is electrically coupled between coupling capacitor C1 and summing node 1725. Non-directional microphone 1720 has a coupling capacitor C2 coupled to its output. Coupled to the output of C2 is inverter 1737 with adjustable phase delay 1739. The adjustable phase delay is an adjustable low pass filter. The inverter 1737 is an operational amplifier OPAM1, shown in an inverting configuration. Coupled between capacitor C2 and the input node of OPAMP 1 and the output node of OPAMP 1 is resistor R3. Similarly, coupled between OPAMP 1 input node of OPAMP 1 and the output node of OPAMP 1 is a capacitor C3.

The gain between the input of OPAMP 1 and the output of OPAMP 1 is indicated by the relationship R3/R2. In one preferred embodiment, R3 equals R2, resulting in a unity gain output signal from OPAMP 1.

In one embodiment, the low pass capacitor C3 for the phase delay 1739 is adjustable. By adjusting capacitor C3, and/or resistor R3, the phase delay of the nondirectional microphone 1720 output relative to the non-directional microphone 1718 is adjusted. Coupled to the output node of OPAMP 1 is resistor R5 in series with an adjustable resistor or potentiometer R6. Further, coupled to output signal 1727 is an inverting operational amplifier, OPAMP 2 having an input node and an output node. Coupled between the input node and the output node is resistor R4. Also coupled between the input node and the output node is a capacitor C4. In one embodiment, capacitor C4 and resistor R3 and R4 are adjustable.

When switch 1723 is open, the resulting amplification or gain from the output from non-directional microphone 1718 is the ratio of resistors R4/R1. When switch 1723 is closed, the output gain contribution from microphone 1720 is determined by the ratio of R4/(R5 plus R6). By adjusting the adjustable potentiometer R6, the amplitude of non-directional microphone 1720 of the output signal relative to the output signal amplitude of non-directional microphone 1718 may be adjusted. By adjusting both capacitor C3 and resistor R6, the hearing aid is adjusted to vary the polar directivity pattern of the in-the-ear hearing aid from cardioid to super cardioid as desired. In one embodiment, the values for the circuit components shown in FIG. 17 are as follows: C1=0.01 μF, C2=0.01 μF, C3=0.022 μF, C4=110 pF, R1=10K, R2=10K, R3=10K, R4=1M, R5=10K, and R6=2.2K.

In one embodiment, non-directional microphone 1718 and non-directional microphone 1720 are non-directional microphones as produced by Knowles No. EM5346. In one embodiment, operational amplifiers OPAMP 1 and OPAMP 2 are inverting Gennum Hearing Aid Amplifiers No. 1/4 LX509.

The illustrated hearing aid allows a wearer to switch between a non-directional mode and a directional mode by simple operation of switch 1721 located on the in-the-ear hearing aid. The circuit components which make up the directional microphone system and the hearing aid circuit are all located within the hearing aid housing and coupled to the inside of face plate. Further, by adjustment of the adjustable phase delay and adjustable gain, the directional microphone system is adjusted to vary the polar directivity pattern to account for manufacturing differences. It may be desirable to adjust the polar directivity pattern between cardioid and super cardioid for various reasons, such as to compensate for limited inlet spacing due to small ears or to compensate for the manufacturing tolerances between the non-directional microphones. It is also recognized that capacitor C4 and resistor R4 are able to be adjusted to compensate for each individual's hearing loss situation.

The associated circuitry allows the two non-directional microphones to be positioned very close together and still produce a directional microphone system having a super cardioid polar directivity pattern. Further, the directional microphone system is able to space the two microphones less than one inch apart in order for the directional microphone system to be incorporated into an in-the-ear hearing aid device. In one embodiment, the two microphones are spaced about 0.33 inches apart. In one embodiment, the two microphones are spaced about 0.2 inches apart. The in-the-ear hearing aid circuitry, including the directional microphone system circuitry and the hearing aid circuit circuitry, utilize microcomponents and may further utilize printed circuit board technology to allow the directional microphone system and hearing aid circuit to be located within a single in-the-ear hearing aid.

Figure 18:
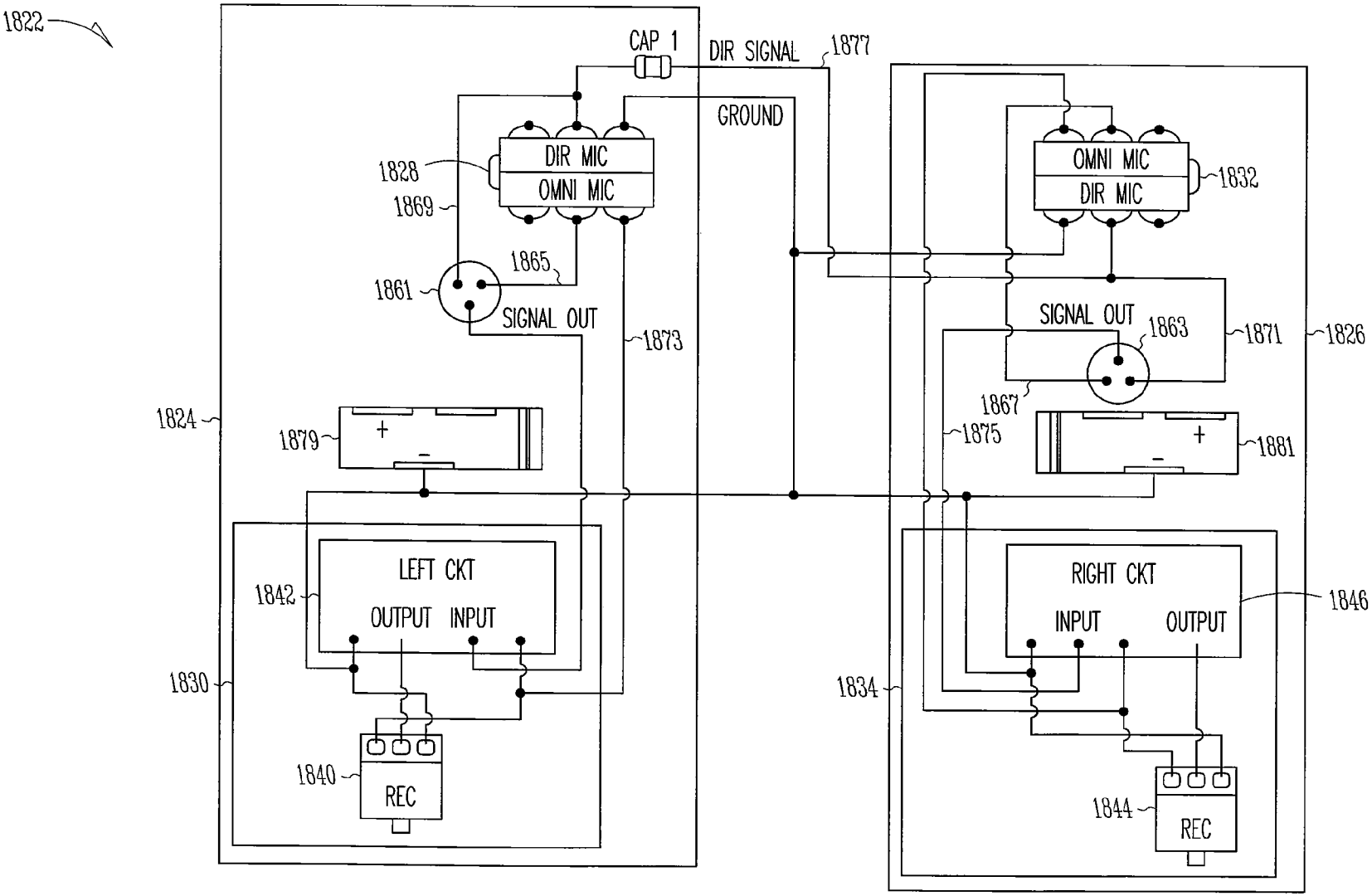
FIG. 18 illustrates a diagram of one embodiment of a hard-wired hearing aid system that diotically presents second-order gradient directional hearing aid signals.

FIG. 18 illustrates a diagram of one embodiment of a hard-wired hearing aid system that diotically presents second-order gradient directional hearing aid signals. The illustrated embodiment of the system 1822 includes a first hearing aid device 1824 that includes a first microphone system 1828 and a first receiver circuit 1830; and further includes a second hearing aid device 1826 that includes a second microphone system 1832 and a second receiver circuit 1834. The microphone systems 1828 and 1832 are switch-selectable omnidirectional-directional microphone systems. The first receiver circuit 1830 includes a first receiver 1840 and a first processing circuit 1842; and the second receiver circuit 1834 includes a second receiver 1844 and a second processing circuit 1846.

In the illustrated embodiment, the switch-selectable omnidirectional-directional microphone systems include a single-cartridge acoustic directional-omnidirectional microphone. One of ordinary skill in the art will understand, upon reading and comprehending this disclosure, how to incorporate a switch-selectable, electrically-summed dual-omnidirectional directional microphone system as illustrated in FIGS. 16 and 17, for example, in the switch-selectable omnidirectional-directional microphone systems.

The first and the second hearing aid devices 1824 and 1826 include a first switch 1861 and a second switch 1863, respectively. The switches are connected to selectively provide either an omnidirectional signal on line 1865 and 1867 from the omnidirectional microphone system or a directional signal on line 1869 and 1871 from the directional microphone system as the output signal on line 1873 and 1875 to the processing circuit 1842 and 1846. The output 1869 of the directional microphone system for the first hearing aid device is coupled to the output 1871 of the directional microphone system for the second hearing aid device via line 1877 such that the directional hearing aid signals are summed at the nodes represented by lines 1869 and 1871. Thus, when the switches 1861 and 1863 are positioned to select a directional mode of operation, the sum of the directional hearing aid signals is presented as a second-order gradient directional signal to both the first processing circuit 1842 and the second processing circuit 1846. In one embodiment, a capacitor CAP1 is used to AC couple the directional microphones.

A first battery for providing power to the first hearing aid device 1824 is shown at 1879, and a second battery for providing power to the second hearing aid device 1826 is shown at 1881. The negative terminal of the batteries are connected together to provide a common reference voltage between the two hearing aid devices. The negative terminal of the batteries are appropriately connected to the microphone systems, the processing circuits and the receivers. The positive terminal of the batteries are also appropriately connected to the microphone system, the processing circuit and the receivers (although not shown).

Figure 19:
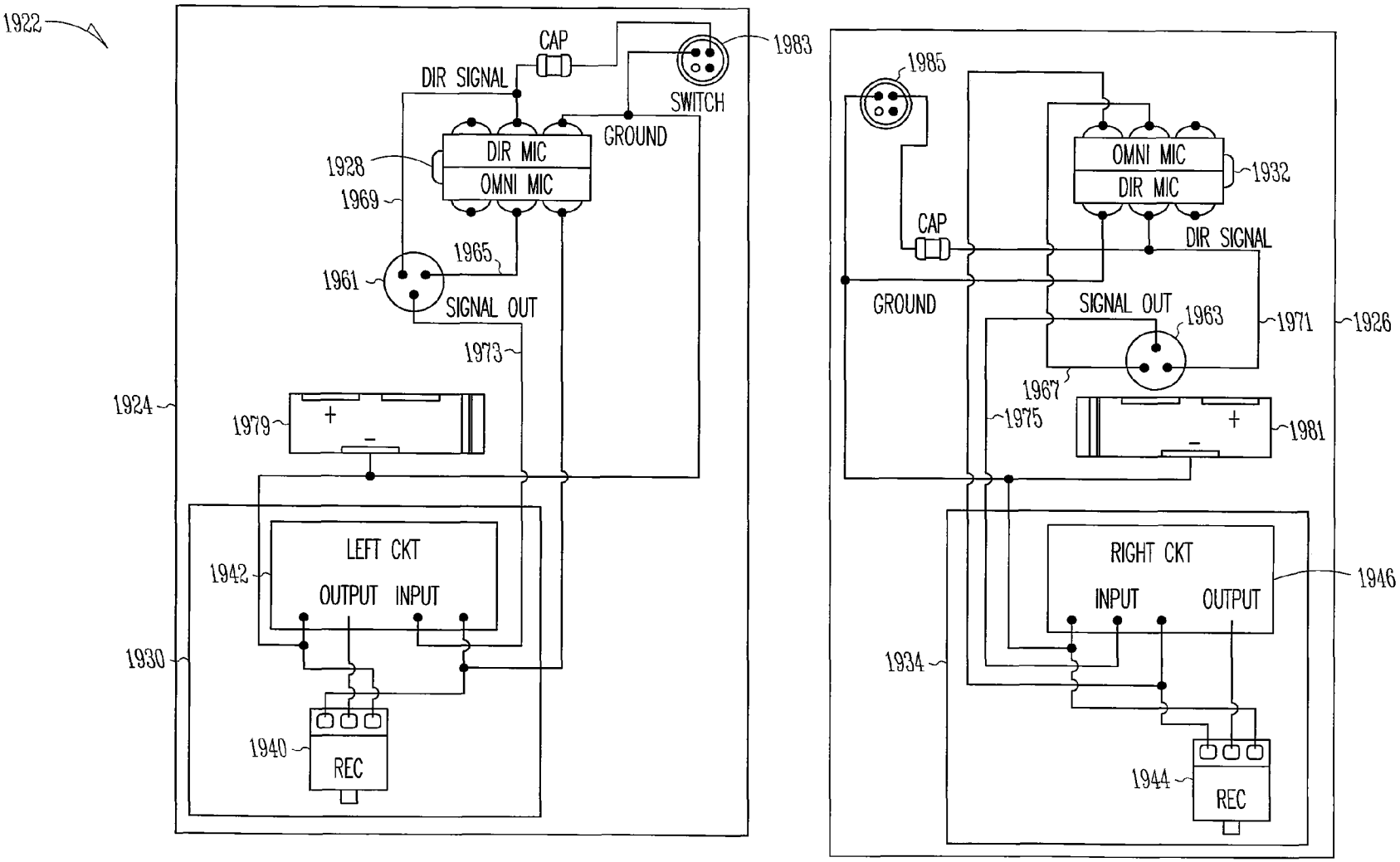
FIG. 19 illustrates a diagram of one embodiment of a hearing aid system that diotically presents second-order gradient directional hearing aid signals, wherein the system includes a removable cord between two hearing aids.

FIG. 19 illustrates a diagram of one embodiment of a hearing aid system that diotically presents second-order gradient directional hearing aid signals, wherein the system includes a removable cord between two hearing aids. This embodiment is similar to the embodiment previously shown and described with respect to FIG. 18. This embodiment includes a first switch 1961 and a second switch 1963 to selectively provide an omnidirectional signal on line 1965 and 1967 from the omnidirectional microphone system or a directional signal on line 1969 and 1971 from the directional microphone system as the output signal on line 1973 and 1975 to the processing circuit 1942 and 1946. This embodiment includes a first socket 1983 for the first hearing aid device 1924 and a second socket 1985 for the second hearing aid device 1926. The output signal and the common ground reference signal for each hearing device are appropriately connected to their respective sockets. A removable cord, such as that previously shown and described with respect to the system of FIG. 10, is attached to the sockets. When the cord is attached and both microphone systems are providing a first-order directional signal as an output signal on lines 1973 and 1975, the cord allows the two first-order directional output signals to be summed to form a second-order gradient directional signal at the nodes represented by lines 1969 and 1971. The second-order gradient directional signal is presented to both the first processing circuit 1942 and the second processing circuit 1946 on lines 1973 and 1975, respectively.

Figure 20:
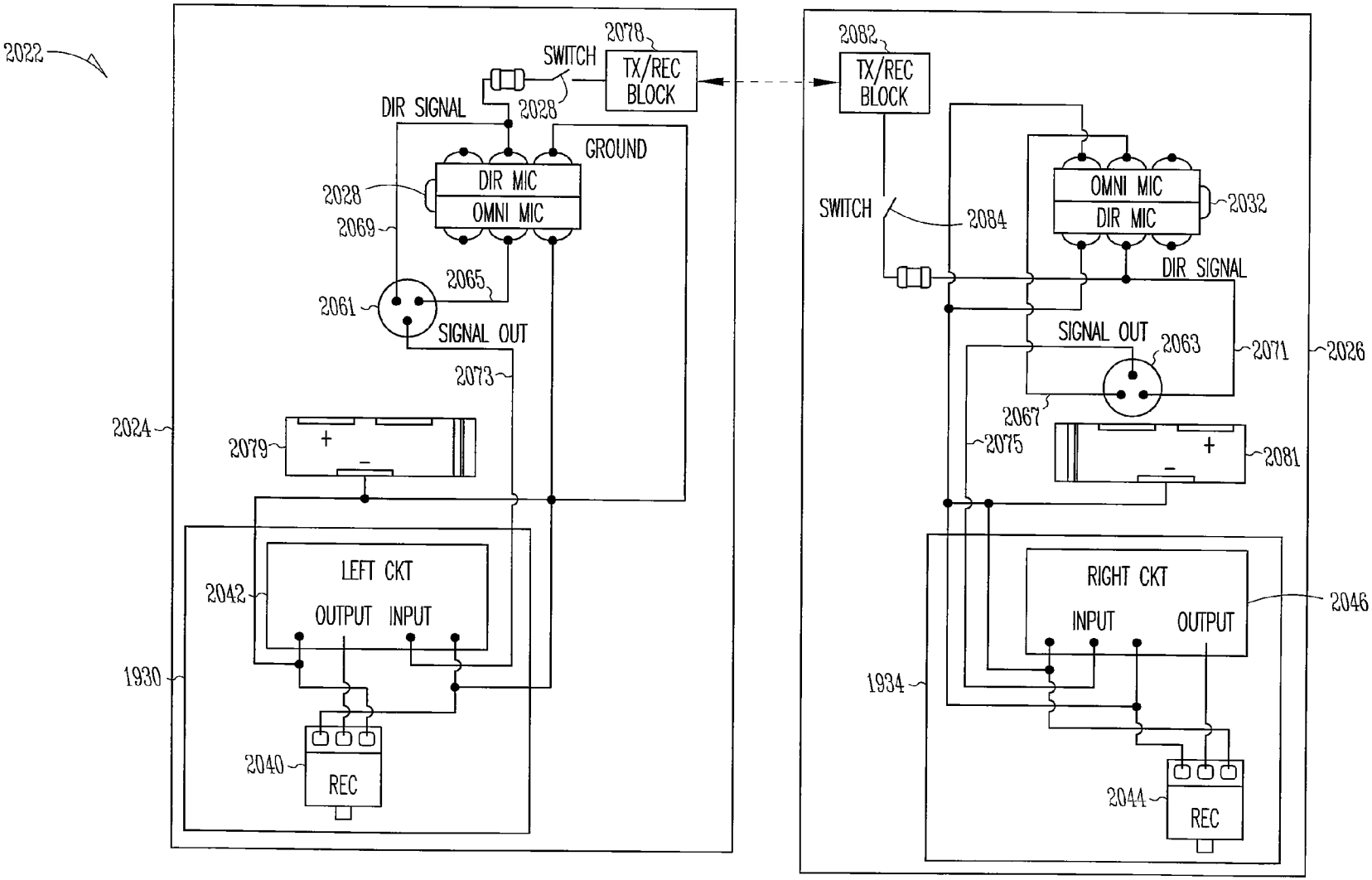
FIG. 20 illustrates a diagram of one embodiment of a hearing aid system that diotically presents second-order gradient directional hearing aid signals, wherein the system includes a wireless transmission between two hearing aids.

FIG. 20 illustrates a diagram of one embodiment of a hearing aid system that diotically presents second-order gradient directional hearing aid signals, wherein the system includes a wireless transmission between two hearing aids. This embodiment includes a first switch 2061 and a second switch 2063 to selectively provide an omnidirectional signal on line 2065 and 2067 from the omnidirectional microphone system or a directional signal on line 2069 and 2071 from the directional microphone system as the output signal on line 2073 and 2075 to the processing circuit 2042 and 2046. This embodiment is similar to the embodiments previously shown and described with respect to FIGS. 18 and 19. In this embodiment, the first hearing aid device 2024 includes a first transceiver block 2078 coupled to the output of the first directional microphone system, and the second hearing aid device 2026 includes a second transceiver block 2082 coupled to the output of the second directional microphone system. In one embodiment, capacitors are used to AC couple the directional microphone systems to the transceivers, respectively. In one embodiment, switches 2080 and 2084 are used to selectively disconnect the transceivers from the output of the directional microphone. Disconnecting the switches 2080 and 2084 allows the two hearing aid devices 2024 and 2026 to operate as two individual first-order gradient directional instruments.

This embodiment of the hearing aid system uses wireless communication between the hearing aid devices. Examples of wireless communication include, but are not limited to, induction and RF transmission.

The present subject matter has disclosed switches. These switches are not limited to a particular type switch, For example, the present subject matter is capable of using various switches, including but not limited to mechanical switches, inductive reed switches, electronic switches and programmable software switches. According to various embodiments, programmable memories are used to cause the hearing aid devices to operate in various modes of operations.

One embodiment of the present subject matter provides a hearing aid system that has at least three modes of operation. A sound is received at a first microphone system in a first hearing aid unit and at a second microphone system in a second hearing aid unit. For a first mode of operation, a first omnidirectional signal representative of the sound from the first microphone system is provided to a first receiver in the first hearing aid unit. A second omnidirectional signal representative of the sound from the second microphone system is provided to a second receiver in the second hearing aid unit. This first mode is beneficial in situations where there is little noise and the user desires to listen to sounds in all directions. For a second mode of operation, a first directional signal representative of the sound from the first microphone system is provided to the first receiver in the first hearing aid unit. A second directional signal representative of the sound from the second microphone system is provided to the second receiver in the second hearing aid unit. This second mode is beneficial in situation where there is more noise. The user is able to detect a conversation, for example, in front of him but loses ability to hear sounds to the back or to the sides. For a third mode of operation, the first directional signal from the first microphone system is summed with the second directional signal from the second microphone system to form a second-order gradient directional signal representative of the sound. The second-order gradient directional signal is diotically presented to the first receiver in the first hearing aid unit and to the second receiver in the second hearing aid unit. This third mode is beneficial in even noisier situation as it provides more directionality. There is some loss of low-frequency response in the third mode, and there is additional loss in the ability to hear sounds to the back or to the sides.

As has been provided above, the present subject matter provides improved systems, devices and methods for providing hearing aid signals with more directionality to improve communications in high noise levels. The hearing aid system includes a directional microphone system and a receiver at each ear. Output signals from the directional microphone systems are combined to provide a second-order gradient directional signal, which is presented to the receiver at both ears. The second-order gradient directional signal provides an improved signal-to-noise ratio, and an expected directivity index of about 9 dB throughout most of the frequency range. The diotic presentation of the second-order gradient signal improves communication in high noise levels.

One of ordinary skill in the art will understand, upon reading and comprehending this disclosure, that the present subject matter is capable of being incorporated in a variety of hearing aids. For example, the present subject mater is capable of being used in custom hearing aids such as in-the-ear, half-shell and in-the-canal styles of hearing aids, as well as for behind-the-ear hearing aids. Furthermore, one of ordinary skill in the art will understand, upon reading and comprehending this disclosure, the method aspects of the present subject matter using the figures presented and described in detail above.

Although specific embodiments have been illustrated and described herein, it will be appreciated by those of ordinary skill in the art that any arrangement which is calculated to achieve the same purpose may be substituted for the specific embodiment shown. This application is intended to cover adaptations or variations of the present subject matter. It is to be understood that the above description is intended to be illustrative, and not restrictive. Combinations of the above embodiments, and other embodiments will be apparent to those of skill in the art upon reviewing the above description. The scope of the present subject matter should be determined with reference to the appended claims, along with the full scope of equivalents to which such claims are entitled.

What is claimed is:

1. A hearing assistance device for a wearer having a first ear and a second ear, comprising:

a microphone system adapted to receive sound about the first ear and provide a first-order directional signal representative of the sound;

a receiver configured to assist hearing by the first ear;

a signal processing circuit adapted to:

receive the first-order directional signal provided by the microphone system; and receive another first-order directional signal from a device adapted to assist hearing of the second ear of the wearer; and provide a second-order directional signal to the receiver using both first-order directional signals.

2. The device of claim 1, wherein the signal processing circuit is adapted to cooperate with the device adapted to assist hearing of the second ear of the wearer to diotically present the second-order directional signal to the first ear and the second ear of the wearer.

3. The device of claim 1, further including a switch to control whether the receiver receives the first-order directional signal provided by the microphone system or receives the second-order directional signal.

4. The device of claim 1, wherein the microphone system is adapted to further provide an omnidirectional signal representative of the sound, and the device further comprises a switch to control whether the receiver receives the first-order directional signal provided by the microphone system or receives the second-order directional signal or receives the omnidirectional signal.

5. The device of claim 1, wherein the microphone system includes a switch-selectable directional-omnidirectional microphone for providing the first-order directional signal or an omnidirectional signal.

6. A method for providing a second-order directional signal, comprising:

receiving sound by a first microphone system in a first hearing aid device adapted to assist hearing in a first ear of a wearer;

receiving sound by a second microphone system in a second hearing aid device adapted to assist hearing in a second ear of the wearer;

creating a first-order directional signal representative of the sound received by the first microphone system;

creating a first-order directional signal representative of the sound received by the second microphone system; and summing both first-order signals to provide a second-order directional signal representative of the sound.

7. The method of claim 6, further comprising presenting the second-order directional signal to a first receiver in the first hearing aid device.

8. The method of claim 7, wherein presenting the second-order directional signal includes presenting the second-order directional signal to the first receiver and to a second receiver in the second hearing aid device to diotically present a sound representative of the second-order directional signal to the first ear and the second ear.

9. The method of claim 6, wherein summing includes adjusting a gain and a phase delay for at least one of the first-order directional signals.

* * * * *